US009346299B2

(12) United States Patent
Ito

(10) Patent No.: US 9,346,299 B2
(45) Date of Patent: May 24, 2016

(54) RECORDING APPARATUS

(71) Applicant: SEIKO EPSON CORPORATION, Tokyo (JP)

(72) Inventor: Tatsuya Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/559,476

(22) Filed: Dec. 3, 2014

(65) Prior Publication Data

US 2015/0183250 A1 Jul. 2, 2015

(30) Foreign Application Priority Data

Dec. 26, 2013 (JP) ..... 2013-270007
Jun. 9, 2014 (JP) ..... 2014-118424

(51) Int. Cl.

| | |
|---|---|
| ***B41J 2/01*** | (2006.01) |
| ***B41J 29/02*** | (2006.01) |
| ***B41J 19/00*** | (2006.01) |
| ***B41J 29/13*** | (2006.01) |
| ***B41J 29/38*** | (2006.01) |

(52) U.S. Cl.

CPC ..... *B41J 29/02* (2013.01); *B41J 19/005* (2013.01); *B41J 29/13* (2013.01); *B41J 29/38* (2013.01)

(58) Field of Classification Search

USPC ..... 347/5, 9, 50, 14
See application file for complete search history.

(56) References Cited

U.S. PATENT DOCUMENTS 5,627,577 A * 5/1997 Buican ..... 347/50
6,234,599 B1 * 5/2001 Ishinaga ..... B41J 2/0451 347/14

FOREIGN PATENT DOCUMENTS

JP 2004-299073 10/2004
JP 2005-125559 5/2005

* cited by examiner

*Primary Examiner* — Lam Nguyen
(74) *Attorney, Agent, or Firm* — Workman Nydegger

(57) ABSTRACT

Provided is a recording apparatus including a controller which controls a recording operation relating to a recording medium, a carriage which can move in a predetermined movement direction, a cable which is connected to both the controller and the carriage and passes across the upper side of at least a part of a carriage movement area in the predetermined movement direction, and a metallic member which partially shields at least a part of the cable, which is a portion extending in a direction intersecting the predetermined movement direction, a guiding member which is formed of metal and guides the cable and a substrate which constitutes the controller. The metallic member is mounted on the guiding member, in a state where the cable is pinched between the metallic member and the guiding member. The metallic member is electrically connected to a ground in the substrate.

16 Claims, 27 Drawing Sheets

RECORDING APPARATUS

BACKGROUND

1. Technical Field

The present invention relates to a recording apparatus for performing recording on a recording medium.

In the application, types of a recording apparatus include a serial printer in which recording is performed in such a manner that a recording head moves in a predetermined direction, a line printer in which a recording head does not move, and apparatuses, such as a copying machine and a facsimile machine, having a function of a printer.

2. Related Art

Hitherto, a plurality of cables for transmitting control signals from a control substrate to a control target, such as a medium transporting mechanism and a recording portion, a power cable and the like have been routed in an ink jet printer as an example of a printer.

When a cable for transmitting signals is arranged close to, for example, a power cable, noise is mixed into signals due to the influence of electromagnetic waves leaking from the power cable. Accordingly, in some cases, stable data transmission is hindered. As a result, there is a concern that an incorrect operation or an operational failure may occur in a printer.

A printer in which, to reduce mixing in of noise due to the influence of electromagnetic waves leaking from the power cable, a cable holder is provided to separately route a signal transmitting cable and a power cable has been disclosed in JP-A-2005-125559.

A countermeasure in which the periphery of the signal cable is covered by a ferrite core is performed as one of the countermeasures to noise. However, in this case, it is necessary to provide, in a routing path of the signal cable in an apparatus, a space for installing a ferrite core. As a result, there is a concern that the size of an apparatus may increase.

An image forming apparatus in which a countermeasure is performed in such a manner that a plurality of metallic portions are conducted through components formed of resin material having conductivity and the noise can be removed by the impedance of the resin material has been disclosed in JP-A-2004-299073.

In the printer disclosed in JP-A-2005-125559, a cable holder having a plate shape is provided in a frame in one end portion in a carriage movement direction, on a side outside the carriage movement area. In the end portion, the cable holder extends in a front-rear direction of the printer. The cable holder is mounted on the frame, in a state where the width direction of the cable holder is parallel to an apparatus height direction. In the printer, a control circuit is disposed on the front side of the apparatus. A cable for transmitting data to a control target extends from the control circuit.

The cable for transmitting data to the carriage extends, for example, in the front side of the printer, from the control circuit to the one end portion in the carriage movement direction. Subsequently, the cable for transmitting data to the carriage is guided by the cable holder and extends from the front side to the rear side of the printer. This cable and the carriage are connected on the rear side of the printer. In the cable holder, the signal transmitting cable and the power cable are arranged by being separated from each other and both the signal transmitting cable and the power cable are guided to extend from the front side to the rear side of the printer.

However, in the printer, a gear group constituted of a plurality of gears for transmitting a driving force from a paper feeding motor to a sub-scanning driving portion is provided outside the carriage movement area, that is, outside the frame in the one end portion.

In other words, since a plurality of cables extending from the front side to the rear side of the printer, the cable holder for guiding the cables, and the gear group are provided outside the carriage movement area, the size of the printer increases in the carriage movement direction, that is, the printer width direction. As a result, the size of the printer increases.

The printer disclosed in JP-A-2004-299073 includes an anti-static brush which is formed of metal and comes into contact with discharged recording paper, an anti-static cap which is formed of conductive resin and comes into contact with the anti-static brush, and a metallic side plate to which the anti-static cap is fixed using a fastening member. The anti-static brush removes charge on the recording paper, in such a manner that the anti-static brush allows the charge to flow to the ground in a case body of the printer.

According to the description of JP-A-2004-299073, when the anti-static cap is disposed in a conduction path, noise can be reduced by the impedance of the anti-static cap. Furthermore, according to the description, there is a problem relating to emission of radiation noise in the case body.

However, when a resin member is constituted of conductive resin, the distribution of conductive material is not necessarily uniform due to molding conditions of the member. Furthermore, the impedance in a conduction path changes depending on a contact position in the resin member. In addition, there is a concern that noise removal may be unstably performed in the resin member. Moreover, conductive resin is obtained in such a manner that an additive agent for imparting conductivity to a resin material is added to the resin material. As a result, the conductive resin results in an increase in costs.

Meanwhile, there are two types of countermeasure to noise. One is an EMI countermeasure in which an apparatus in use is prevented from emitting noise. The other is an EMC countermeasure in which noise resistance properties are enhanced such that, even when an apparatus in use receives noise from outside, the apparatus operates in a normal manner. Even when such a countermeasure to noise is applied, the extent of noise greatly varies depending on the length or the position of a cable. Particularly, the length of a cable is determined in accordance with the position of a substrate. In many cases, when a reduction in the size of a product is attempted, a substrate is positioned on the rear side of an apparatus and a cable is positioned on the front side of the apparatus. Accordingly, the length of the cable increases, and thus the cable easily receives influence of noise from outside. Particularly, when the cable is constituted of a flexible flat cable (FFC) connected to a recording head, failure, such as an incorrect operation or incorrect printing in the recording head, can occur.

SUMMARY

An advantage of some aspects of the invention is to provide a recording apparatus which is able to reduce the size of an apparatus. In addition, an another advantage of some aspects of the invention is to provide a recording apparatus which can stably reduce a noise of a cable that is routed in the downsized recording apparatus.

The invention can be realized in the following forms or application examples.

APPLICATION EXAMPLE 1

According to this application example, there is provided a recording apparatus including a controller which controls a recording operation relating to a recording medium, a first cable which is connected to the controller, and a carriage which can move in a predetermined movement direction, in accordance with control of the controller, in which the first cable passes across the upper side of at least a part of a carriage movement area in the predetermined movement direction.

In this configuration, since the first cable connected to the controller passes across the upper side of at least a part of the carriage movement area, it is not necessary to provide, outside the carriage movement area in the predetermined movement direction, a space for allowing the first cable to pass therethrough. As a result, it is possible to reduce the size of the apparatus in the predetermined movement direction, that is, the width direction of the recording apparatus.

APPLICATION EXAMPLE 2

In the recording apparatus according to the application example, a guiding member which guides the first cable and extends in a direction intersecting the predetermined movement direction is provided above the carriage movement area, at a position which is outside a recording medium transporting path, in the predetermined movement direction.

In this configuration, the guiding member which guides the first cable and extends in the direction intersecting the predetermined movement direction is provided above the carriage movement area, at a position which is outside the recording medium transporting path, in the predetermined movement direction. In other words, the guiding member can reliably hold the cable, in the upper side of the carriage movement area. As a result, it is possible to reduce the possibility that the first cable may fall down into the carriage movement area and thus may hinder the movement of the carriage.

APPLICATION EXAMPLE 3

In the recording apparatus according to the application example, the guiding member is provided in an end portion of the carriage movement area, in the predetermined movement direction.

APPLICATION EXAMPLE 4

In the recording apparatus according to the application example, the carriage includes a recording head which discharges ink onto a recording medium. Furthermore, the first cable guided by the guiding member is electrically connected to the recording head of the carriage.

APPLICATION EXAMPLE 5

In the recording apparatus according to the application example, the recording apparatus further includes a metallic member which partially shields at least a part of the first cable, which is a portion extending in a direction intersecting the predetermined movement direction.

In this configuration, since the first cable connected to the controller passes across the upper side of at least a part of the carriage movement area, it is not necessary to provide, outside the carriage movement area in the predetermined movement direction, a space for allowing the first cable to pass therethrough. As a result, it is possible to reduce the size of the apparatus in the predetermined movement direction, that is, the width direction of the recording apparatus. Furthermore, the metallic member which partially shields at least a part of the first cable, which is the portion extending in the direction intersecting the predetermined movement direction is provided. Accordingly, the metallic member blocks noise acting on the first cable from outside. As a result, it is possible to reduce noise acting on the first cable, and thus it is possible to prevent an incorrect operation of the apparatus. Furthermore, since noise removal is performed by the metallic member, it is possible to reduce costs, compared to in a case of using a resin material.

APPLICATION EXAMPLE 6

In the recording apparatus according to the application example, the recording apparatus further includes a substrate constituting the controller. In addition, the guiding member is formed of metal and is mounted on the guiding member, in a state where the first cable is pinched between the metallic member and the guiding member. Furthermore, the metallic member is electrically connected to a ground in the substrate.

In this configuration, the metallic member is mounted on the guiding member, in a state where the first cable is pinched between the metallic member and the guiding member. In addition, the metallic member is electrically connected to the ground in the substrate. As a result, it is possible to reduce influence of noise from outside.

APPLICATION EXAMPLE 7

In the recording apparatus according to the application example, the recording apparatus further includes a case body and a feeding portion which feeds a medium. Furthermore, in an apparatus height direction intersecting the predetermined movement direction, the metallic member is provided in a space between the case body and the guiding member. In addition, the metallic member is disposed, close to the feeding portion, at a position corresponding to a part of the first cable, which is the portion outside the carriage movement area, in a direction intersecting the predetermined movement direction.

In this configuration, the metallic member is disposed, close to the feeding portion, at the position corresponding to a part of the first cable, which is the portion outside the carriage movement area, in the direction intersecting the predetermined movement direction. Accordingly, it is possible to reduce the size in the apparatus height direction, compared to in the case where the metallic member is disposed above the carriage movement area. In other words, it is possible to prevent an increase in the size of the apparatus in the apparatus height direction.

APPLICATION EXAMPLE 8

In the recording apparatus according to the application example, the substrate is provided on either the rear side of the feeding portion in the case body or the bottom surface of the case body.

APPLICATION EXAMPLE 9

In the recording apparatus according to the application example, the recording apparatus further includes an operation portion which sends a command to the controller. Furthermore, in the apparatus height direction, the guiding member overlaps at least a part of the installation area of the operation portion.

In this configuration, the guiding member overlaps, in the apparatus height direction, with at least a part of the installation area of the operation portion. Thus, it is possible to reduce the size of the apparatus, compared to in the case where the first cable, the guiding member, and the operation portion are arranged, in a stacked manner, in the apparatus height direction. As a result, it is possible to achieve a reduction in the size of the recording apparatus.

APPLICATION EXAMPLE 10

In the recording apparatus according to the application example, the recording apparatus further includes an apparatus main body which is provided with the operation portion and a cover which is pivotally mounted on the apparatus main body and can switch a state between an open state where the operation portion is exposed to the area above the apparatus main body and a closed state where the operation portion is covered by the cover. Furthermore, in the apparatus height direction, the guiding member overlaps at least a part of the cover.

In this configuration, the first cable and the guiding member overlap, in the apparatus height direction, with at least a part of the cover. Thus, it is possible to reduce the height of the apparatus, compared to in the case where the first cable and the guiding member are disposed below the cover. As a result, it is possible to achieve a reduction in the size of the recording apparatus.

APPLICATION EXAMPLE 11

In the recording apparatus according to the application example, the recording apparatus further includes a power transmission mechanism which transmits power from a driving source to means for transporting the recording medium. Furthermore, when the carriage is moved to the end portion in the carriage movement area, the power transmission mechanism is positioned below the carriage and the guiding member is positioned above the carriage, the power transmission mechanism, the carriage, and the guiding member thus overlapping each other.

In this configuration, in a state where the carriage is moved to the end portion in the carriage movement area, the power transmission mechanism is positioned below the carriage and both the first cable and the guiding member are positioned above the carriage. Accordingly, when the carriage is moved to the end portion in the movement area, the guiding member, the first cable, and the power transmission mechanism are positioned, in the predetermined movement direction, not outside the carriage movement area but inside the movement area. Accordingly, it is not necessary to provide, outside the carriage movement area, a space to arrange the guiding member, the first cable, and the power transmission mechanism. Thus, it is possible to reduce the size of the recording apparatus in the predetermined movement direction. As a result, it is possible to achieve a reduction in the size of the recording apparatus.

APPLICATION EXAMPLE 12

In the recording apparatus according to the application example, the guiding member is positioned above a driving motor for driving the carriage.

In this configuration, the guiding member is positioned above the driving motor for driving the carriage. In other words, the guiding member is disposed in a portion between the first cable and the driving motor. Accordingly, the guiding member blocks electromagnetic waves leaking from the driving motor, and thus influence of noise on electric signals transmitted through the first cable can be prevented.

APPLICATION EXAMPLE 13

In the recording apparatus according to the application example, the metallic member is provided, in the predetermined movement direction, in a portion between the feeding portion and the case body.

APPLICATION EXAMPLE 14

In the recording apparatus according to the application example, a part of the guiding member, which is the portion outside the carriage movement area, in the direction intersecting the predetermined movement direction, forms a stepped portion which is positioned, in the apparatus height direction, below a part of the guiding member, which is the portion provided above the carriage movement area. In addition, the metallic member is mounted on the stepped portion.

In this configuration, the metallic member is mounted on the stepped portion which is positioned, in the apparatus height direction, below a part of the guiding member, which is the portion provided above the carriage movement area. Accordingly, the position of the metallic member can be lowered, compared to in the case where the metallic member is mounted on a part of the guiding member, which is the portion provided above the carriage movement area. As a result, it is possible to prevent an increase in the size of the apparatus in the apparatus height direction.

APPLICATION EXAMPLE 15

In the recording apparatus according to the application example, the recording apparatus further includes a metal frame which forms the apparatus main body. In addition, the guiding member is connected to the metal frame.

APPLICATION EXAMPLE 16

In the recording apparatus according to the application example, the metal frame includes a first frame and a second frame which are assembled together and form the apparatus main body. In addition, the guiding member is in contact with the first frame. The second frame is directly/indirectly connected to the substrate. Furthermore, the metallic member is electrically connected to the ground in the substrate, through the guiding member, the first frame, and the second frame.

In this configuration, the metallic member is electrically connected to the ground in the substrate, through the guiding member, the first frame and the second frame. Accordingly, the metallic member is electrically earthed, and thus it is possible to stably reduce influence of noise on the first cable. Furthermore, since a path for earthing the metallic member is constituted by the frame constituting the apparatus main body, it is not necessary to separately provide a path for earthing the metallic member. As a result, the configuration of the apparatus can be simplified and it is possible to prevent an increase in the size of the apparatus.

APPLICATION EXAMPLE 17

In the recording apparatus according to the application example, the recording apparatus further includes a second cable which extends from the operation portion and is connected to the controller. Furthermore, the metallic member shields the second cable.

In this configuration, since the metallic member shields not only the first cable but also the second cable, it is not necessary to shield the first cable and the second cable, using separate members. Accordingly, since both cables are shielded by one member, it is possible to achieve space saving and a reduction in costs.

APPLICATION EXAMPLE 18

According to this application example, there is provided a recording apparatus including a controller which controls a recording operation relating to a recording medium, an operation portion which sends a command to the controller, a first cable which is connected to the controller and a metallic member which shields at least a part of the first cable. Furthermore, in the apparatus height direction, the metallic member overlaps at least a part of the installation area of the operation portion.

In this configuration, the metallic member overlaps, in the apparatus height direction, with at least a part of the installation area of the operation portion. Thus, it is possible to reduce the size of the apparatus, compared to in the case where the first cable, the metallic member, and the operation portion are arranged, in a stacked manner, in the apparatus height direction. As a result, it is possible to achieve a reduction in the size of the recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
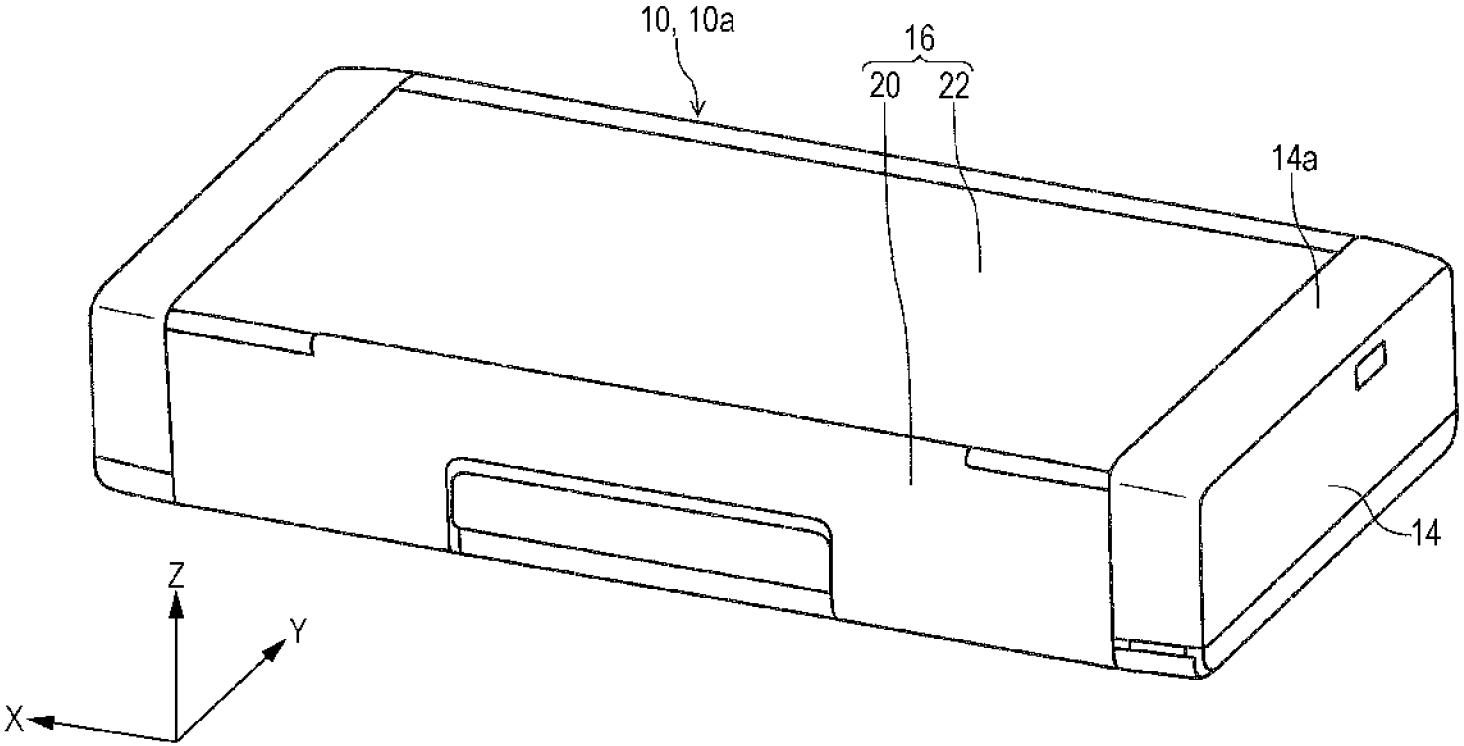
FIG. 1 is a perspective view of the appearance of a printer in a state where a cover is closed.

Hereinafter, embodiments of the invention will be described with reference to the accompanying drawings. The same reference numerals and signs are given to components having the same configurations in the embodiments. The configurations thereof will be described in only a first embodiment and will not be repeated in succeeding embodiments.

Embodiment 1

Figure 2:
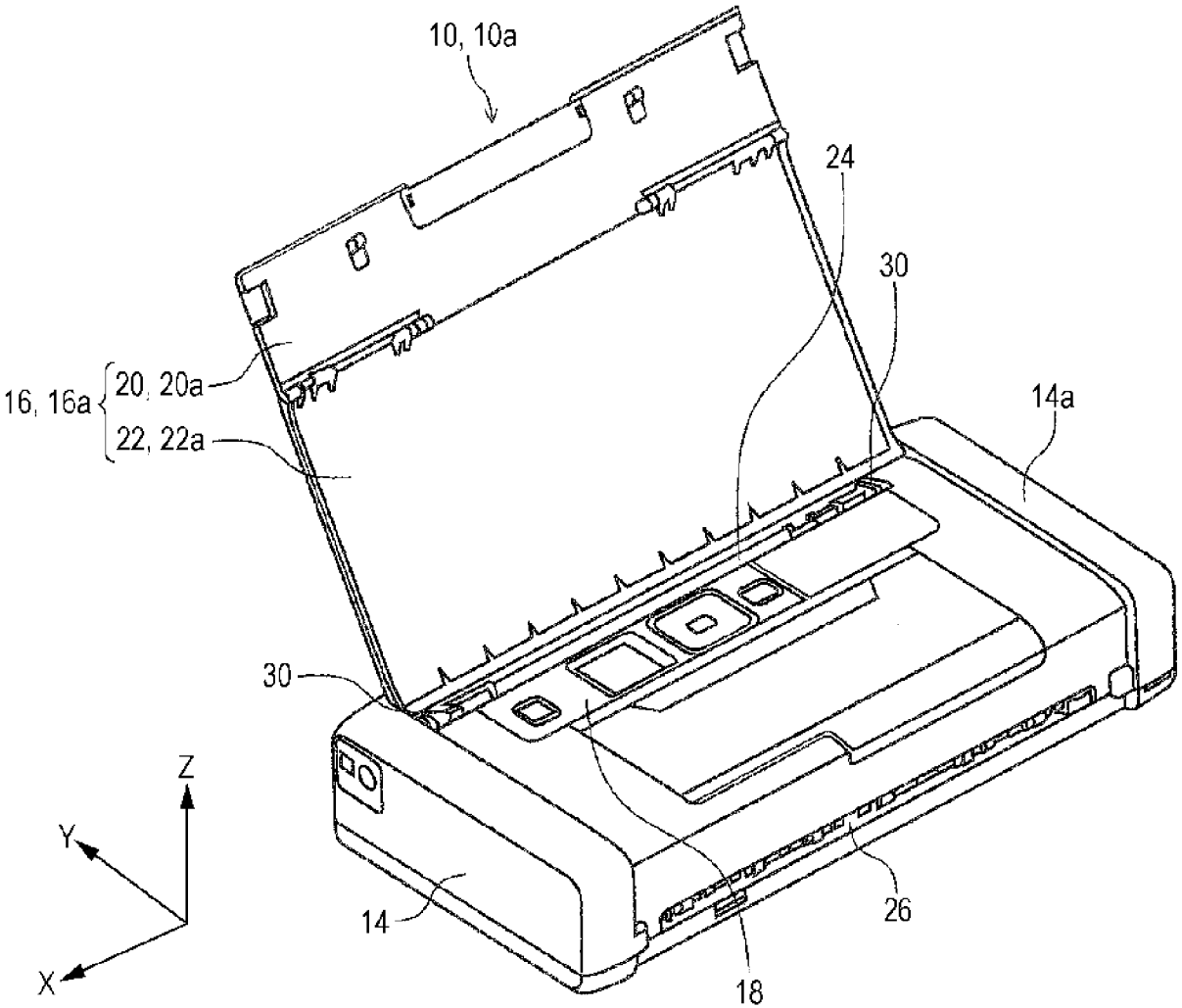
FIG. 2 is a perspective view of the appearance of the printer in a state where the cover is open.
Figure 3:
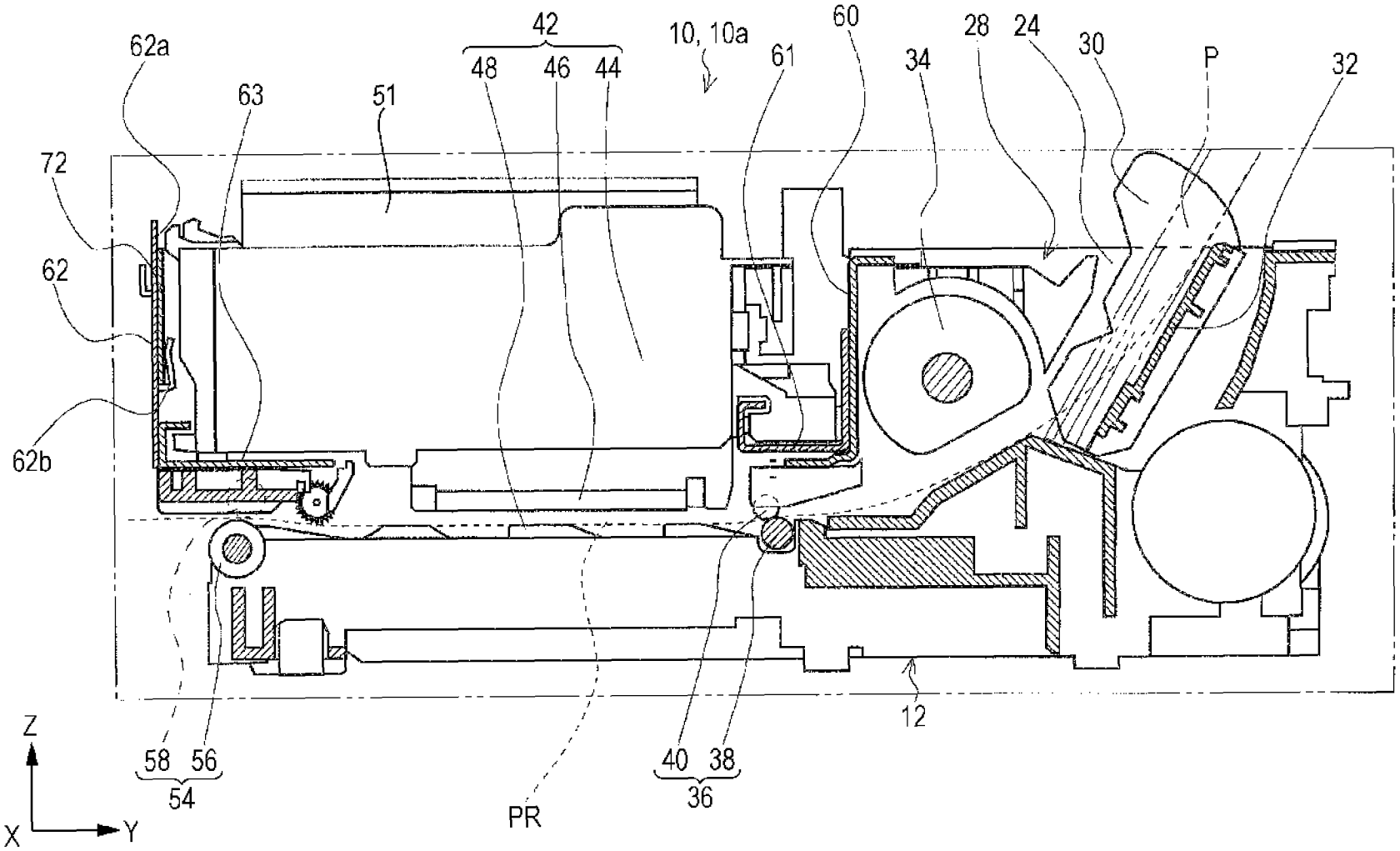
FIG. 3 is a lateral cross-sectional view illustrating a medium transporting path in the printer.
Figure 4:
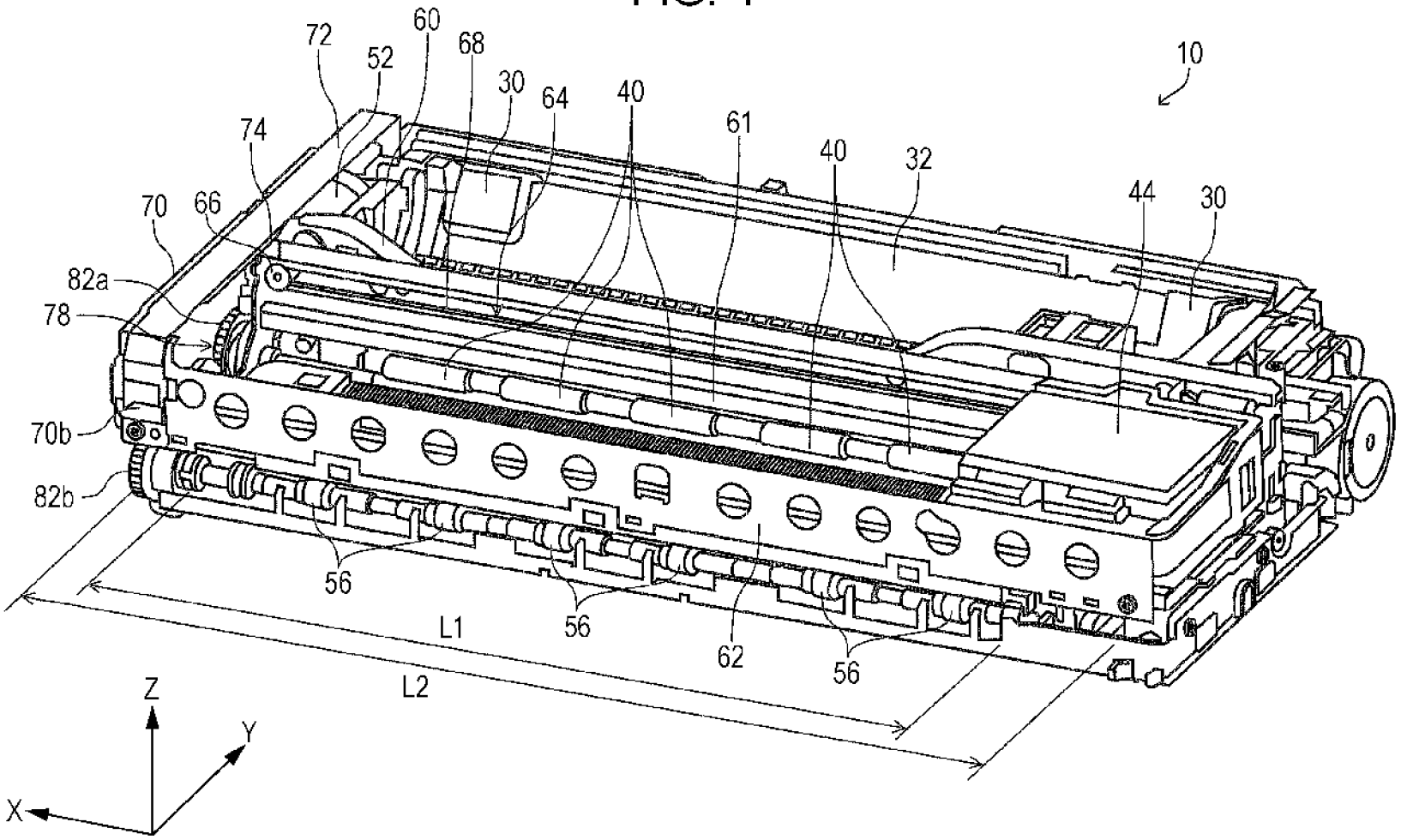
FIG. 4 is a perspective view of the appearance of an apparatus main body in the printer.
Figure 5:
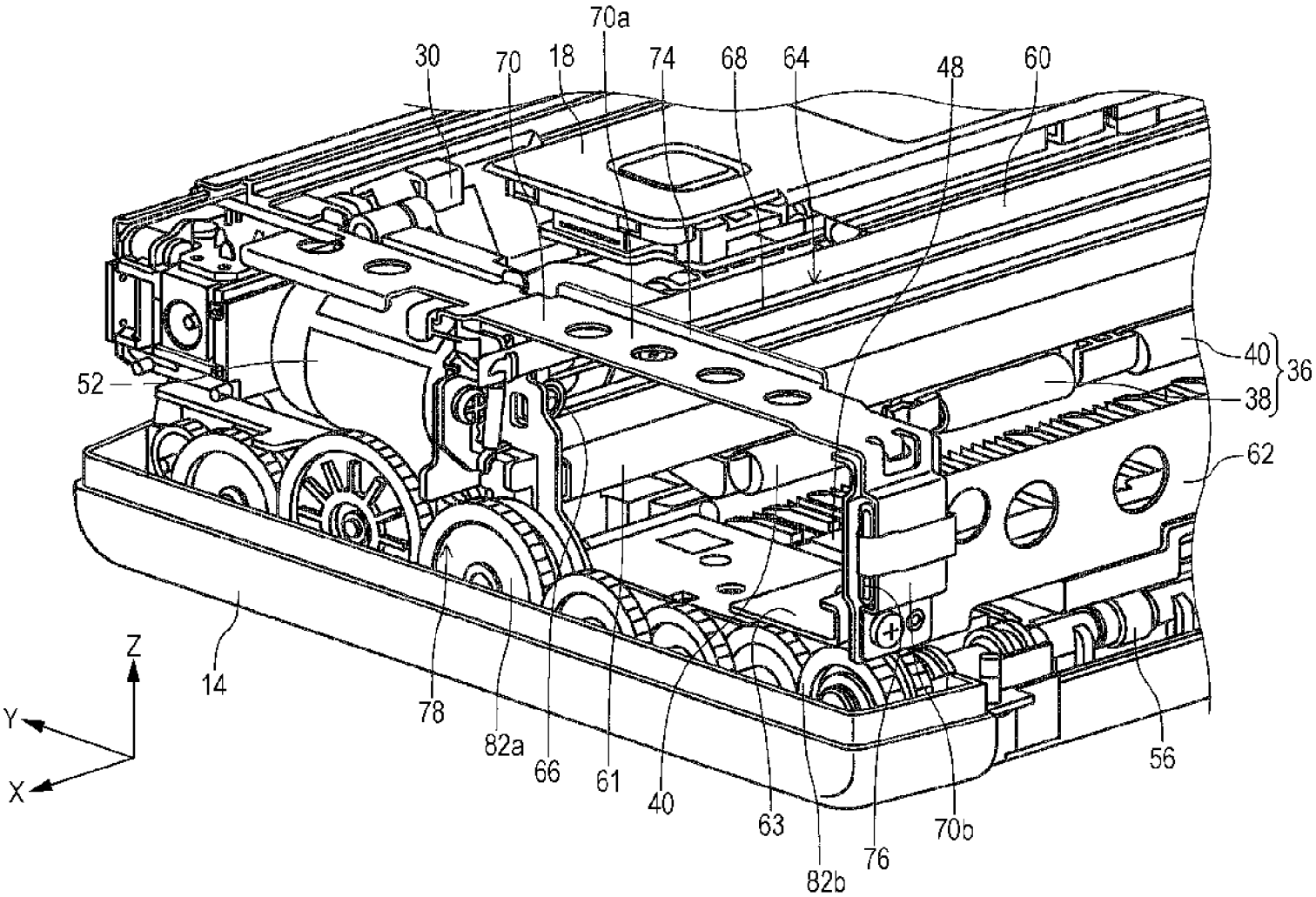
FIG. 5 is a perspective view illustrating the appearance of one end portion in a carriage movement area.

FIG. 1 is a perspective view of the appearance of a printer of the invention in a state where a cover is closed. FIG. 2 is a perspective view of the appearance of the printer of the invention in a state where the cover is open. FIG. 3 is a lateral cross-sectional view illustrating a medium transporting path in the printer of the invention. FIG. 4 is a perspective view of the appearance of an apparatus main body in the printer of the invention. FIG. 5 is a perspective view illustrating the appearance of one end portion in a carriage movement area.

Figure 6:
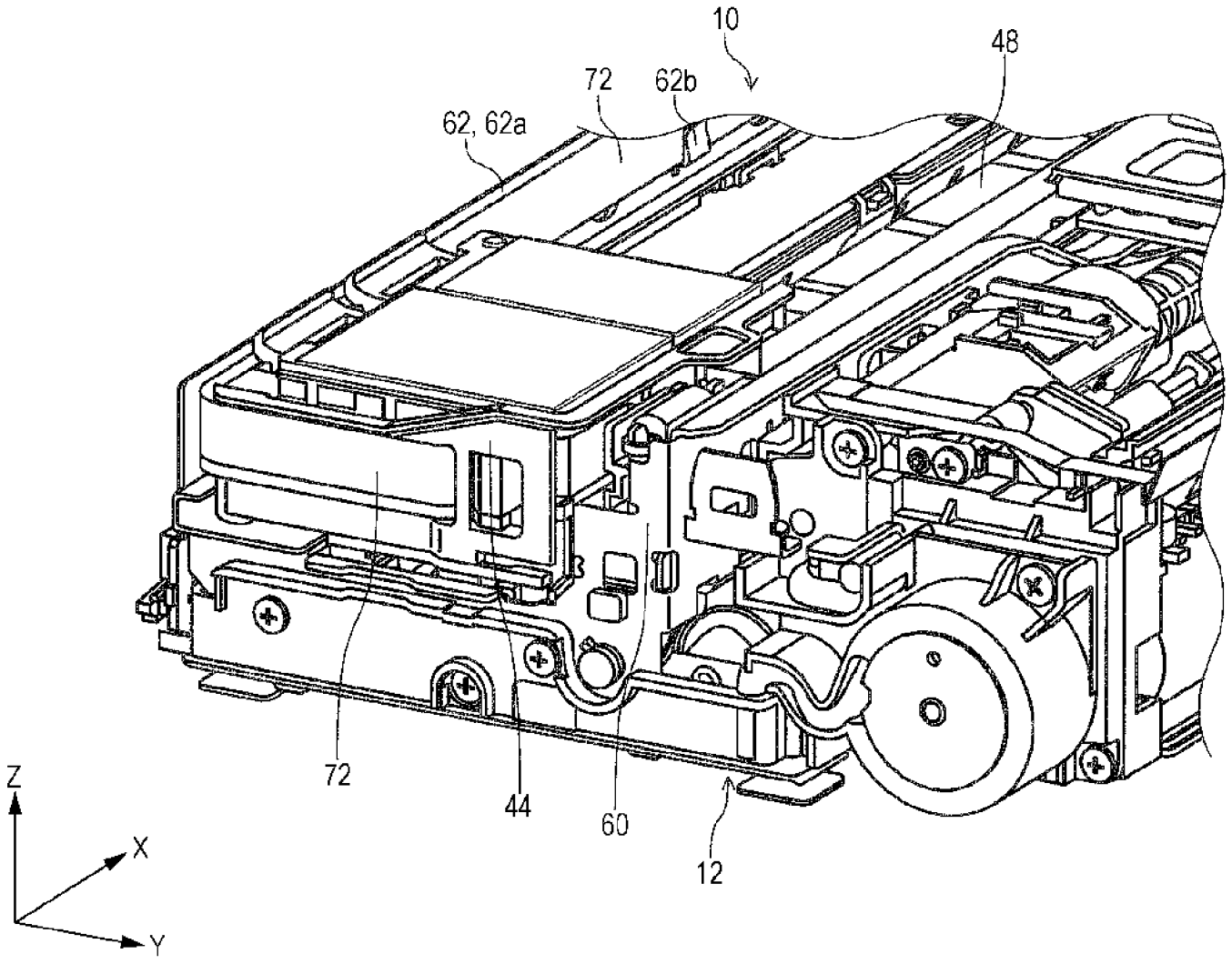
FIG. 6 is a perspective view illustrating the appearance of the other end portion in the carriage movement area.
Figure 7:
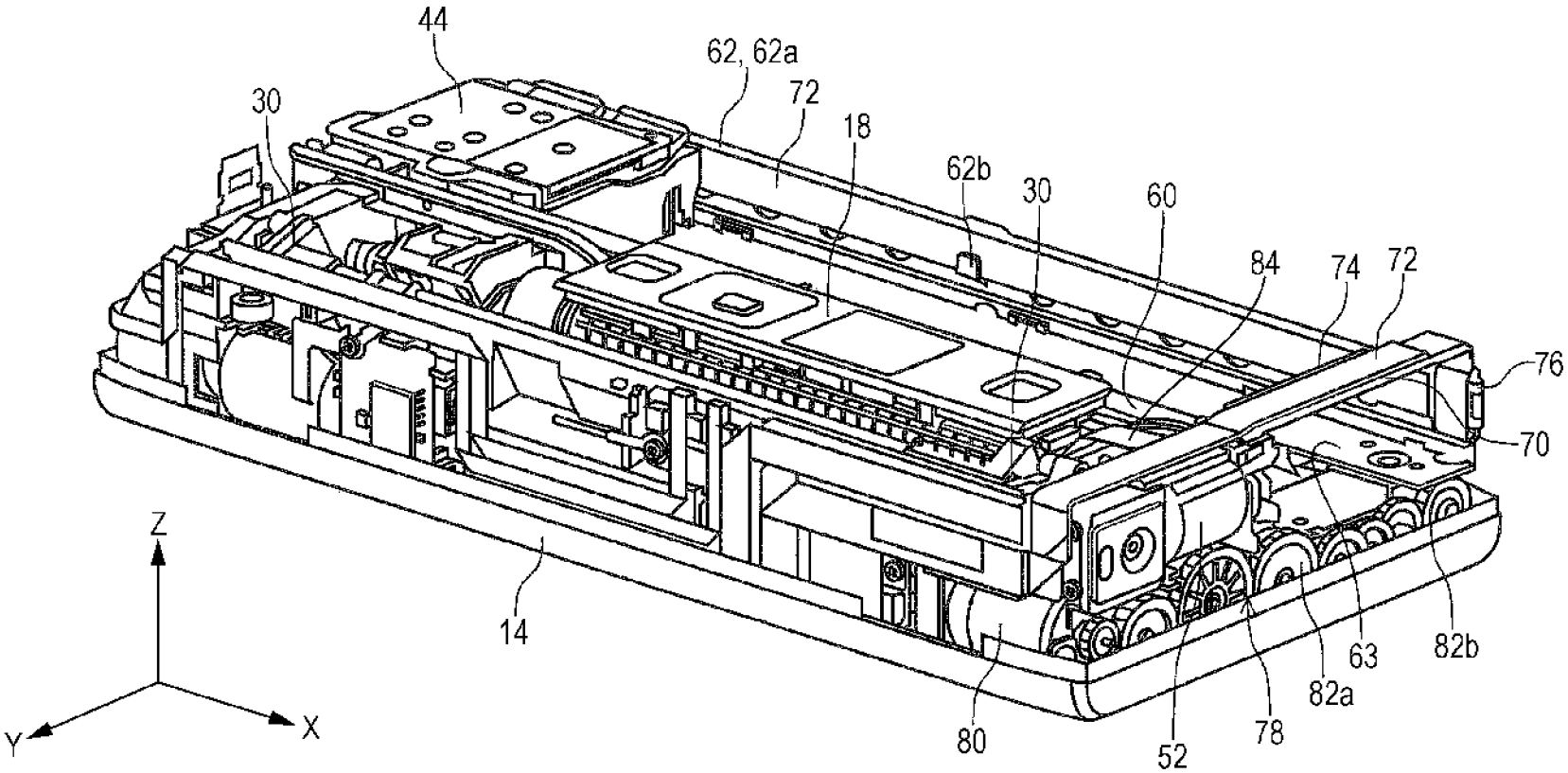
FIG. 7 is a rear-side perspective view of the apparatus main body in the printer.
Figure 8A:
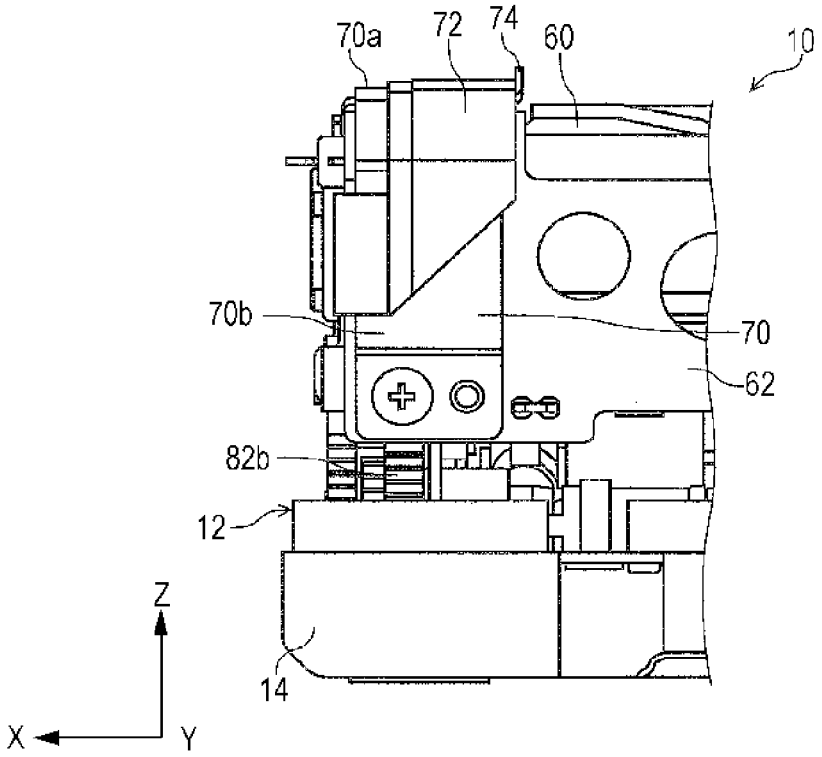
FIG. 8A is a front view illustrating a state where a cable is disposed in a guiding member in the one end portion in the carriage movement area.
Figure 8B:
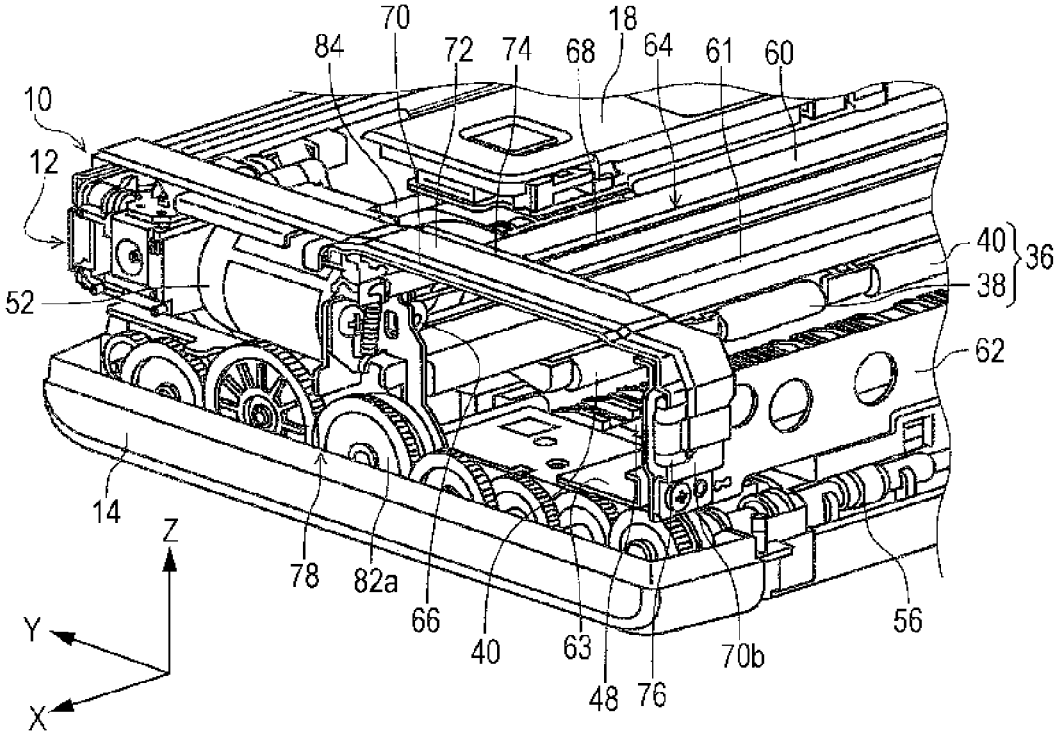
FIG. 8B is a perspective view illustrating the appearance in a state where the cable is disposed in the guiding member in the one end portion.
Figure 9:
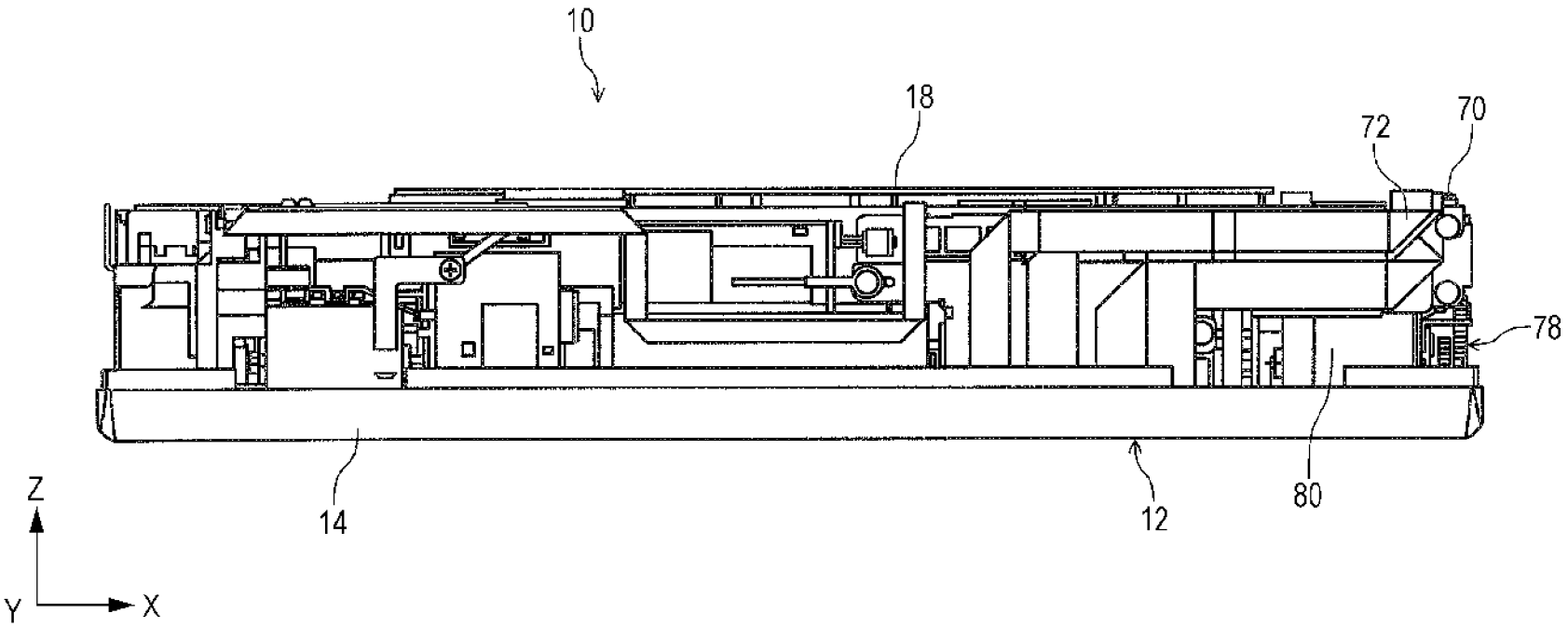
FIG. 9 is a rear view illustrating a cable routing state in a rear side of the printer.
Figure 10:
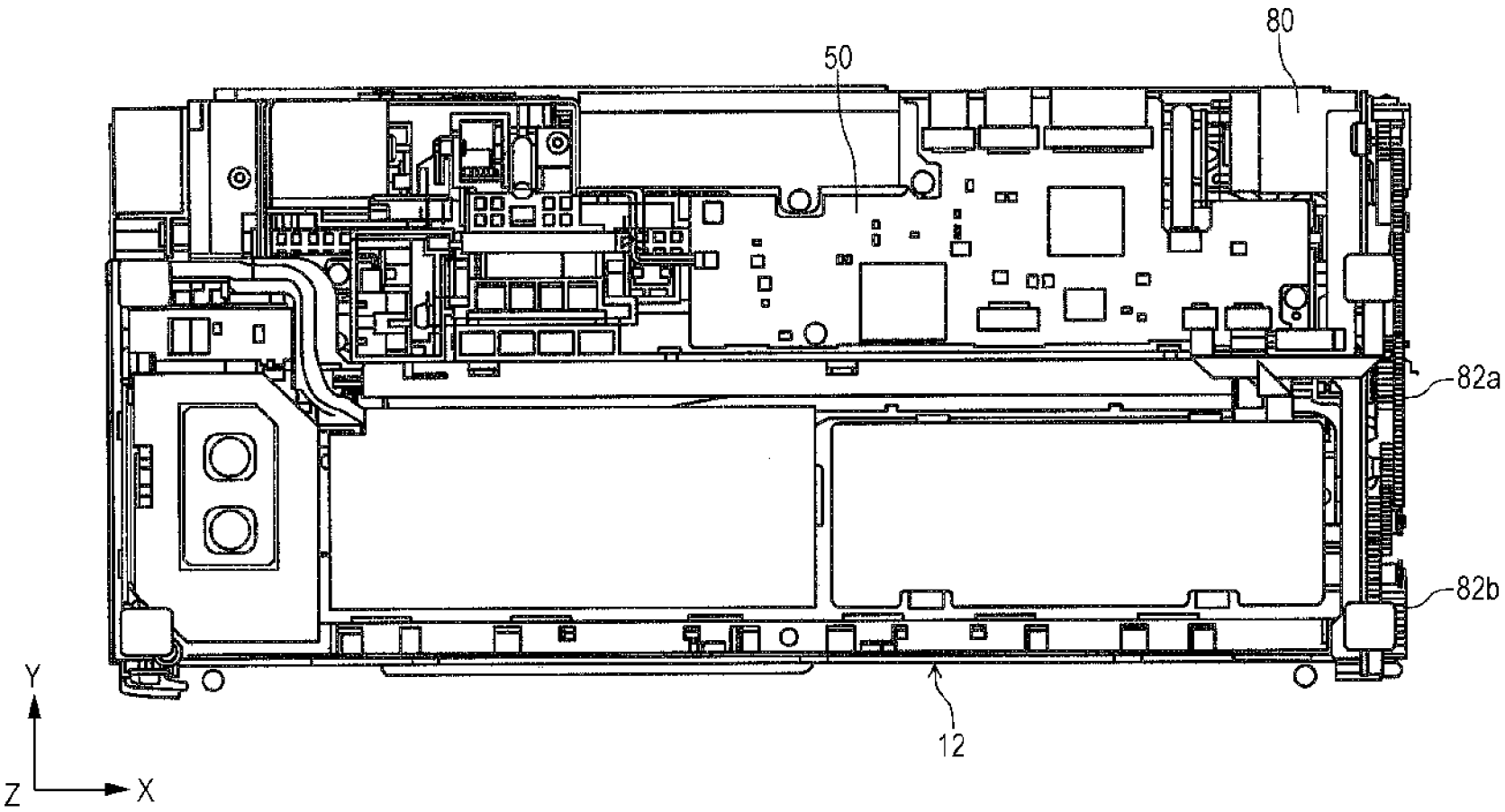
FIG. 10 is a bottom view illustrating a lower surface of the apparatus main body in the printer.

FIG. 6 is a perspective view illustrating the appearance of the other end portion in the carriage movement area. FIG. 7 is a rear-side perspective view of the apparatus main body in the printer of the invention. FIG. 8A is a front view illustrating a state where a cable is disposed in a guiding member in the one end portion in the carriage movement area and FIG. 8B is a perspective view illustrating the appearance in a state where the cable is disposed in the guiding member in the one end portion. FIG. 9 is a rear view illustrating a cable routing state in a rear side of the printer. FIG. 10 is a bottom view illustrating a lower surface of the apparatus main body in the printer.

Figure 11:
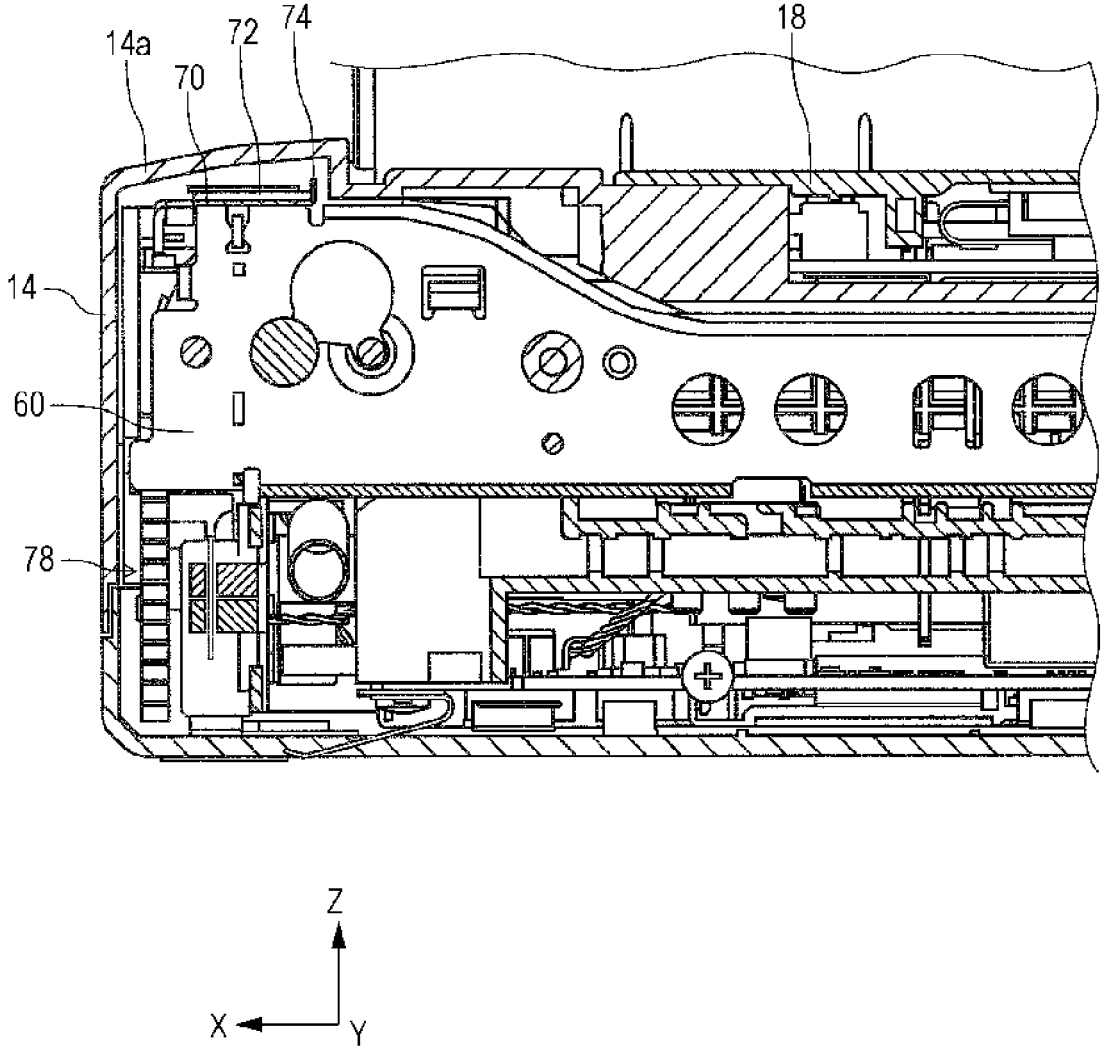
FIG. 11 is a front view illustrating the arrangement of both the guiding member and the cable in the one end portion in the carriage movement area.
Figure 12:
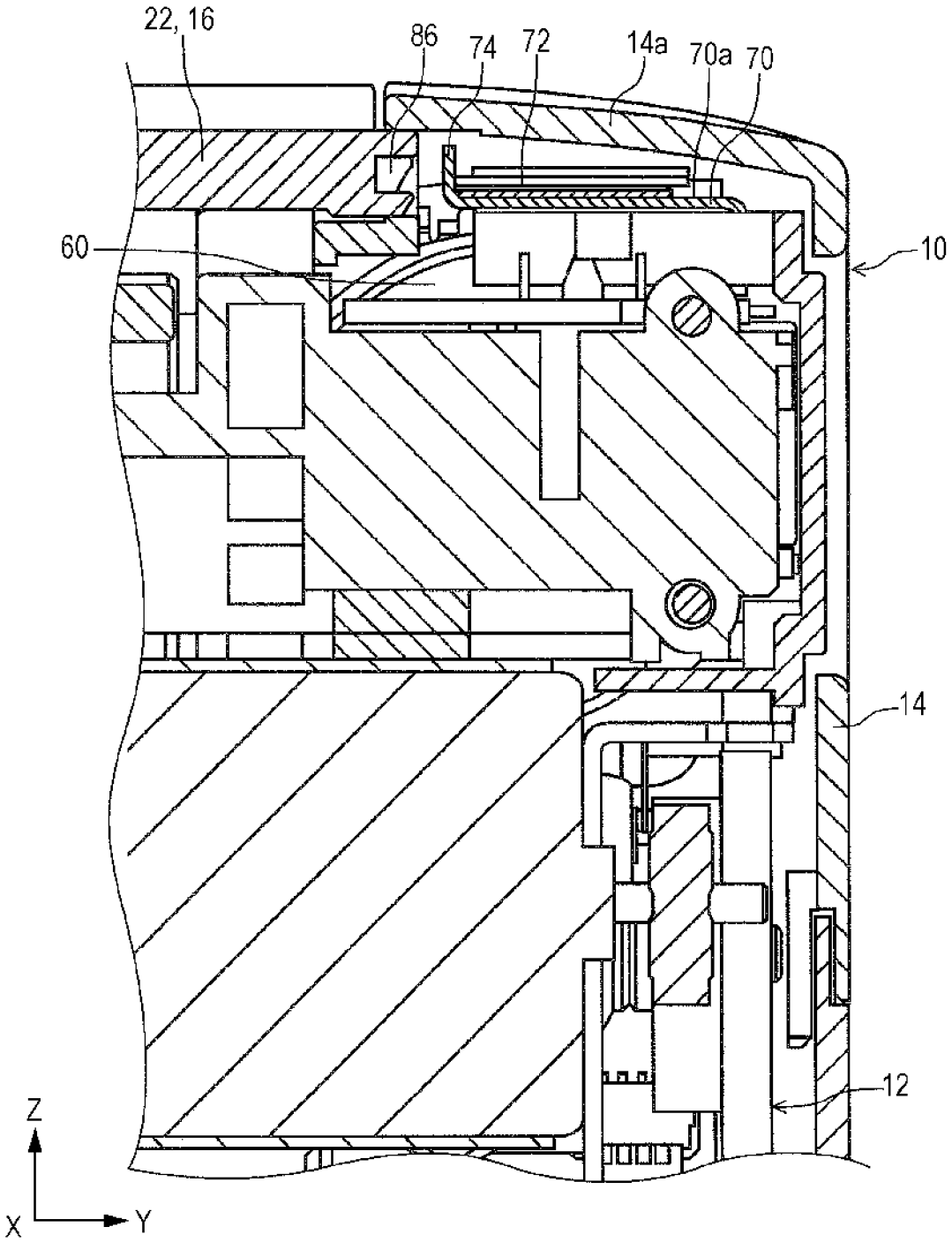
FIG. 12 is a rear view illustrating the arrangement of both the guiding member and the cable in the one end portion in the carriage movement area.
Figure 13:
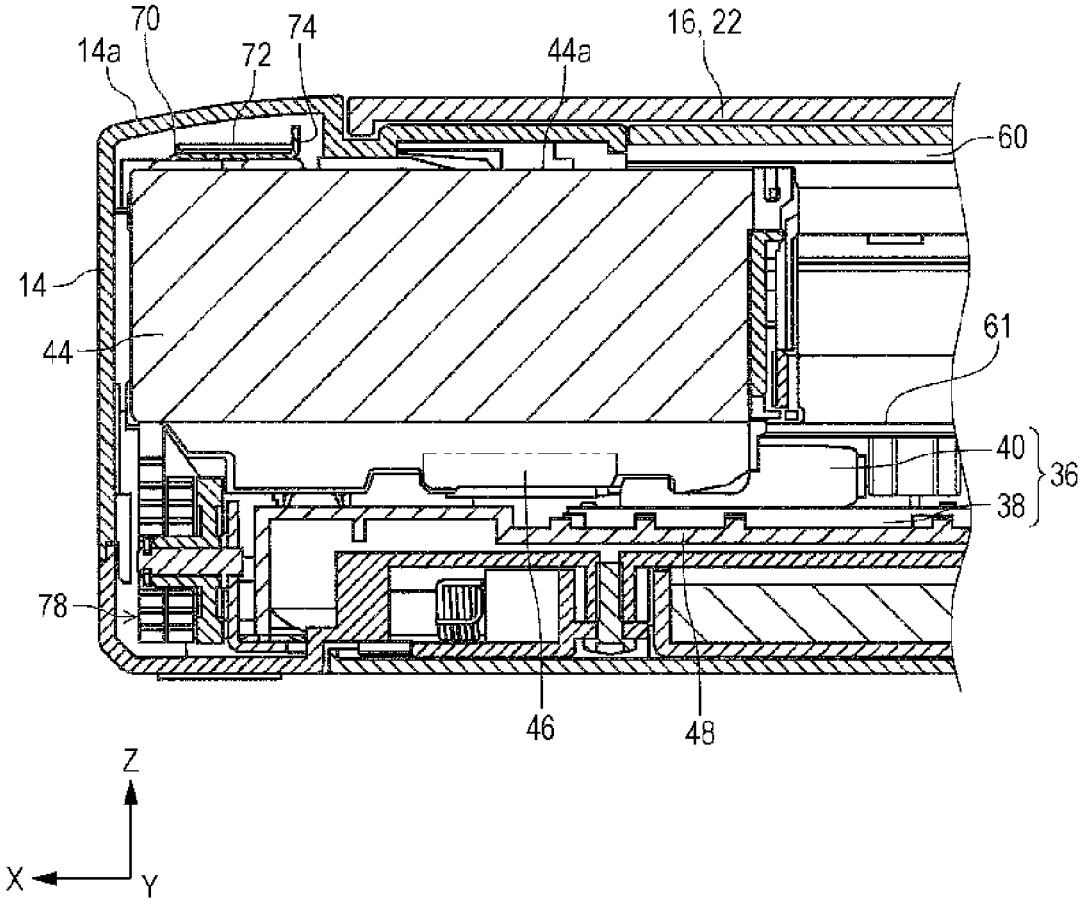
FIG. 13 illustrates the arrangement of both the guiding member and the cable in a state where the carriage is located in the one end portion in the carriage movement area.
Figure 14:
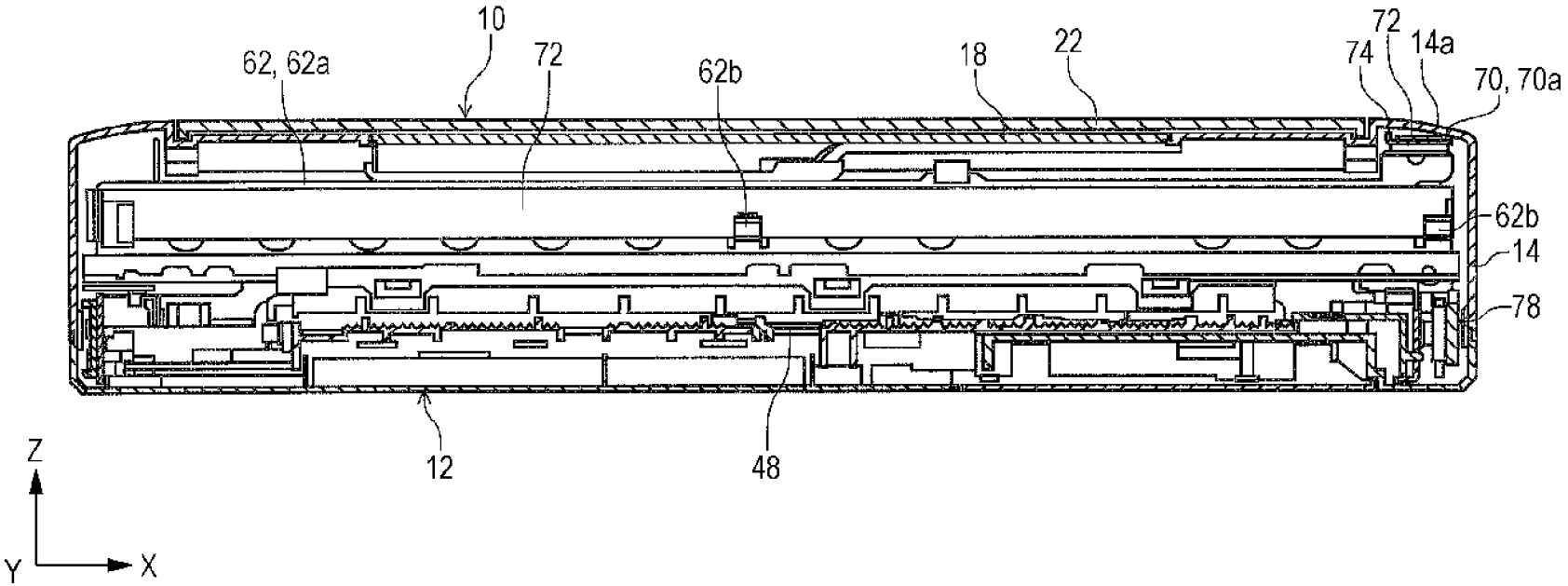
FIG. 14 is a rear view illustrating the cable in a state where the cable is disposed on a guiding surface of a guide frame on the front side of the apparatus.
Figure 15:
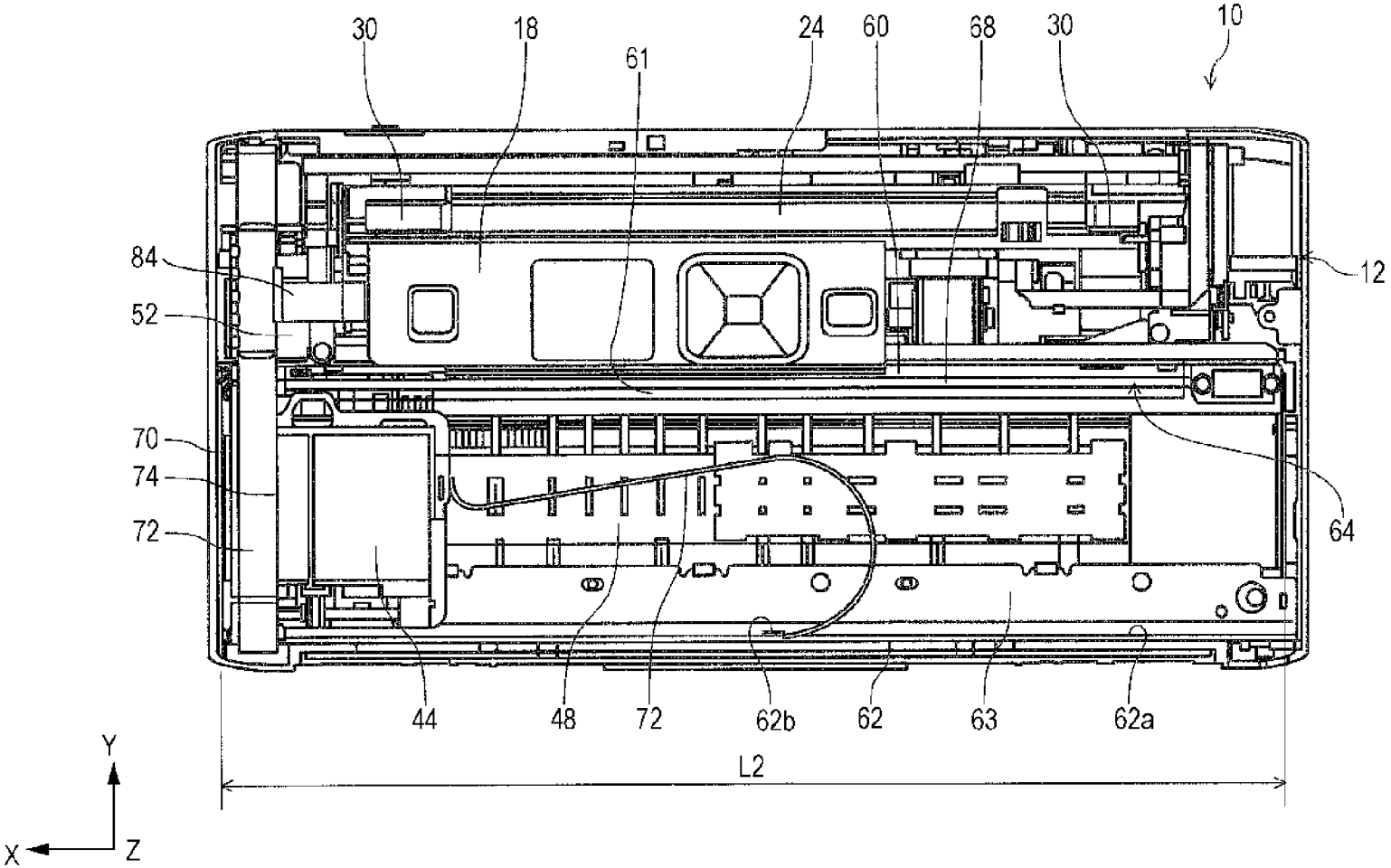
FIG. 15 is a plan view illustrating the carriage movement area.

FIG. 11 is a front view illustrating the arrangement of both the guiding member and the cable in the one end portion in the carriage movement area. FIG. 12 is a rear view illustrating the arrangement of both the guiding member and the cable in the one end portion in the carriage movement area. FIG. 13 is a front view illustrating the arrangement of both the guiding member and the cable in a state where the carriage is located in the one end portion in the carriage movement area. FIG. 14 is a rear view illustrating the cable in a state where the cable is disposed on a guiding surface of a guide frame on the front side of the apparatus. FIG. 15 is a plan view illustrating a carriage movement area L2 in the invention.

In the X-Y-Z coordinate system used for illustration in each drawing, an X direction is a scanning direction of a recording head, a Y direction is a depth direction of a recording apparatus, and a Z direction is a direction, that is, an apparatus height direction, in which a distance (a gap) between the recording head and a medium changes. Furthermore, in each drawing, a −Y directional side is a front side of the apparatus and a +Y directional side is a rear side of the apparatus. L1 in FIG. 4 illustrates a transporting path area of a paper sheet P in an X-axis direction and L2 illustrates a movement area of a carriage 44 in the X-axis direction.

Schematic Configuration of Printer

Components of an ink jet printer 10 (hereinafter, referred to as a "printer 10") as an example of the recording apparatus will be described with reference to FIGS. 1 and 2. The ink jet printer 10 includes an apparatus main body 12 (see FIG. 4), a housing 14, a cover portion 16, and an operation portion 18. The housing 14 covers the periphery of the apparatus main body 12 and forms the appearance of the printer 10. The cover portion 16 can be open or closed with respect to the apparatus main body 12. When the cover portion 16 is open, the operation portion 18 is exposed to the area above the apparatus main body 12.

The cover portion 16 includes a front cover portion 20 and an upper cover portion 22. The front cover portion 20 is pivotally mounted on the upper cover portion 22. The upper cover portion 22 is pivotally mounted on the apparatus main body 12.

In a state where the cover portion 16 is closed with respect to the apparatus main body 12 (see FIG. 1), the front cover portion 20 constitutes a part of a front surface of the housing 14. Furthermore, in a state where the cover portion 16 is closed, the upper cover portion 22 constitutes a part of an upper surface 14*a* of the housing 14.

Meanwhile, when the cover portion 16 pivots, with respect to the apparatus main body 12, in a counter-clockwise direction in FIG. 2, the cover portion 16 moves from a front side (which is the −Y-axis directional side in FIG. 2) of the apparatus to a rear side (which is the +Y-axis directional side in FIG. 2) of the apparatus. The state of the cover portion 16 is switched to an open state illustrated in FIG. 2. In this case, the front cover portion 20 pivots with respect to the upper cover portion 22, and thus both an inner surface 20*a* of the front cover portion 20 and an inner surface 22*a* of the upper cover portion 22 form one surface as an inner surface of the cover portion 16. In this embodiment, when the cover portion 16 is in a state (illustrated in FIG. 2) where the cover portion 16 is open with respect to the apparatus main body 12, the inner surface of the cover portion 16 functions as a mounting surface 16*a* for a paper sheet P as a "recording medium".

Next, when the state of the cover portion 16 is switched from the closed state (see FIG. 1) to the open state, as illustrated in FIG. 2, both the operation portion 18 and a paper supply port 24 are exposed to the area above the apparatus main body 12 and a discharge port 26 is exposed on the front side of the apparatus main body 12. The operation portion 18 includes a power button, a print setting button, a display panel, and the like for operating the printer 10.

When the paper sheet P is mounted on the mounting surface 16*a* of the cover portion 16, the paper sheet P is supplied from the mounting surface 16*a* to the inner portion of the apparatus main body 12, through the paper supply port 24. The paper sheet P supplied, through the paper supply port 24, from the mounting surface 16*a* to the inner portion of the apparatus main body 12 is subjected to recording by a recording portion 42 described below, and then the paper sheet P is discharged through the discharge port 26, toward the side (which is the −Y-axis directional side in FIG. 2) in front of the apparatus.

Next, the details of the components on a transporting path of a paper sheet will be described with reference to FIG. 3. The right side (the rear side of the apparatus) of the paper of FIG. 3 is the upstream side of a feeding path and the left side (the front side of the apparatus) of the paper is the downstream side of the feeding path. The broken line in FIG. 3 illustrates a transporting path PR of the paper sheet P.

A paper supply portion 28 is provided on the upstream side of the feeding path. The paper supply portion 28 feeds the paper sheet, from the mounting surface 16*a* of the cover portion 16 in an open state with respect to the housing 14 to the downstream side of the feeding path. The paper supply portion 28 includes the paper supply port 24, a pair of paper guiding portions 30, a paper supporting portion 32, and a feeding roller 34. The pair of paper guiding portions 30 are provided in the paper supply port 24. The paper supporting portion 32 supports at least a part of the paper sheet inserted through the paper supply port 24. The feeding roller 34 is disposed facing the paper supporting portion 32. Both the cover portion 16 and the paper supporting portion 32 support the paper sheet P, in a state where the paper sheet P is inclined.

The paper supporting portion 32 has a shape inclined downward toward the −Y directional side in FIG. 3. In addition, the feeding roller 34 can oscillate in a contact/separation direction, with respect to the paper sheet P mounted on the paper supporting portion 32. When the feeding roller 34 is displaced in a direction in which the feeding roller 34 moves closer to the paper supporting portion 32, the feeding roller 34 comes into contact with the uppermost paper sheet of the paper sheets P mounted on the paper supporting portion 32 and the feeding roller 34 feeds the uppermost paper sheet P to the downstream side of the feeding path.

A transporting portion 36 is provided in the area downstream from the paper supply portion 28. The transporting portion 36 includes a transport driving roller 38 and a transport driven roller 40. The transport driving roller 38 is pivoted by a roller driving motor 80 (see FIG. 7). The transporting portion 36 transports the paper sheet P fed from the paper supply portion 28 to the downstream side in the transporting direction, in a state where the paper sheet P is nipped between the transport driving roller 38 and the transport driven roller 40. The recording portion 42 is provided on the downstream side of the transporting portion 36.

The recording portion 42 includes the carriage 44, a recording head 46, and a platen 48. The recording head 46 is provided on a bottom portion of the carriage 44. The platen 48 faces the recording head and functions as a support portion for supporting a medium.

The recording head 46 faces a medium supported by the platen 48. The carriage 44 is driven to reciprocate in a main scanning direction (which is a front-back direction of the paper sheet of FIG. 3, that is, the X-axis direction) as a "predetermined movement direction", by a carriage driving motor 52 (see FIG. 5) controlled by a control substrate 50 (see FIG. 10) as a "controller" in the apparatus main body 12. In addition, the distance (the gap) between the recording surface of a medium and a head surface of the recording head 46 is set in such a manner that the platen 48 supports the paper sheet P from below.

A discharging portion 54 is provided on the downstream side of the recording portion 42 in the transporting direction. The discharging portion 54 includes a discharge driving roller 56 and a discharge driven roller 58. The paper sheet P subjected to recording by the recording portion 42 is discharged to the side in front of the apparatus through the discharge port 26 formed on the front surface of the apparatus, in a state where the paper sheet P is nipped between the discharge driving roller 56 and the discharge driven roller 58. Furthermore, the discharge driving roller 56 is rotated by the roller driving motor 80 (see FIG. 7).

The control substrate 50 controls operations, such as a feeding operation, a transporting operation, a discharging operation, and a recording operation of a paper sheet, necessary for performing recording on the paper sheet P in the transporting portion 36, the recording portion 42 and the discharging portion 54 of the printer 10, in accordance with a command input from the operation portion 18. In addition, the control substrate 50 also controls rotation of both the carriage driving motor 52 (see FIG. 5) and a roller driving motor 80 (see FIG. 7).

The configuration of the apparatus main body 12 will be described with reference to FIGS. 4 and 5. A main frame 60 as a "first frame" and a guide frame 62 as a "second frame" are provided in the apparatus main body 12, as illustrated in FIG. 4. The main frame 60 and the guide frame 62 extend in the X-axis direction and are spaced apart in the Y-axis direction. A guide frame 61 is installed, as a "guiding portion" in the main frame 60. In addition, a guide frame 63 is installed, as a "guiding portion", in the guide frame 62. The guide frames 61 and 63 support the carriage 44. The upper surfaces of the guide frames 61 and 63 function as a sliding surface. Both the main frame 60 and the guide frame 62 are formed of metallic material. In this embodiment, both frames are formed of aluminum alloy as an example of a metallic material.

A guiding surface 62*a* is provided in the guide frame 62 to guide a cable 72 described below in the X-axis direction (see FIGS. 7 and 14). In the guiding surface 62*a*, cable fixing hooks 62*b* and 62*b* are provided at two positions which are an end portion on the +X-axis directional side in the X-axis direction and the central portion in the X-axis direction, as illustrated in FIG. 14.

A carriage driving mechanism 64 is provided in the main frame 60. The carriage driving mechanism 64 receives a driving force from the carriage driving motor 52 and moves the carriage 44 in the X-axis direction. The carriage driving mechanism 64 includes a driving pulley 66, a driven pulley (not illustrated), and a timing belt 68.

The driving pulley 66 is mounted on a driving shaft of the carriage driving motor 52. The timing belt 68 is wound around both the driving pulley 66 and the driven pulley (not illustrated). The carriage 44 grips a part of the timing belt 68, using a grip portion (not illustrated) provided on the rear side of the carriage 44. Accordingly, when the carriage driving motor 52 rotates the driving pulley 66, the carriage 44 slides, due to the timing belt 68, on both guide frames 61 and 63 (see FIG. 3) in the X-axis direction.

A guiding member 70 is provided in an end portion on the +X-axis directional side of the movement area of the carriage 44, in the X-axis direction, as illustrated in FIG. 5. In other words, the guiding member 70 is provided at a position outside the transporting path area L1 (see FIG. 4) of the paper sheet P, in the movement area L2 (see FIG. 4) of the carriage 44 in the X-axis direction. The guiding member 70 extends in the Y-axis direction and is mounted on the guide frame 62, in a state where the guiding member 70 is bent, in the −Z-axis direction, on the front side (which is the −Y-axis directional side) of the apparatus main body 12.

The guiding member 70 is also mounted on the main frame 60. Furthermore, the guiding member 70 extends through the side on the +Z-axis direction of the carriage driving motor 52, that is, the side above the carriage driving motor 52 mounted on the main frame 60 and extends to the rear side (which is the +Y-axis directional side) of the apparatus main body 12. In this embodiment, the guiding member 70 is formed of metallic material, to reduce, for example, influence of static electricity. Furthermore, in this embodiment, the guiding member 70 is formed of aluminum alloy to reduce weight.

Since the guiding member 70 connects the main frame 60 and the guide frame 62, the main frame 60 and the guide frame 62 support each other through the guiding member 70. Thus, the rigidity thereof is increased. As a result, the guiding member 70 can reinforce both the main frame 60 and the guide frame 62.

In the guiding member 70, the surface on the +Z-axis directional side constitutes a guiding surface 70*a* which has the cable 72 described below disposed thereon and guides the cable 72. A bent portion 74 extending in the Y-axis direction is provided in a part of the guiding member 70, that is, the end portion of the guiding member 70 in the −X-axis direction. The bent portion 74 protrudes from the guiding surface 70*a* to the +Z-axis directional side and functions as a guide for the cable 72. The guiding member 70 is a plate-shaped member, and thus the bent portion 74 in the end portion of the guiding member 70 on the −X-axis directional side also functions as a reinforcing portion for reinforcing the guiding member 70.

Accordingly, the guiding member 70 is located above (the +Z-axis directional side) the carriage driving motor 52 for driving the carriage 44. In other words, the guiding member 70 is located in a portion between the cable 72 described below and the carriage driving motor 52. Accordingly, the guiding member 70 blocks electromagnetic waves leaking from the carriage driving motor 52, and thus influence of noise on electric signals transmitted through the cable 72 can be prevented.

A mounting portion 70*b* of the guiding member 70 is a portion by which the guiding member 70 is mounted on the guide frame 62. A ferrite core 76 is provided in a portion between the mounting portion 70*b* and the guide frame 62, to reduce noise in the cable 72 described below.

Next, a roller driving mechanism 78 as a "power transmission mechanism" for driving both the transport driving roller 38 and the discharge driving roller 56 as transporting means will be described. In the rear side (which is the +Y-axis directional side) of the apparatus main body 12, the roller driving motor 80 is provided in the end portion on the +X-axis directional side, as illustrated in FIG. 7.

Furthermore, in the apparatus main body 12, the roller driving mechanism 78 constituted of a plurality of gears is provided in the end portion on the +X-axis directional side. In the end portion on the +X-axis directional side, the roller driving mechanism 78 is located on the bottom side (which is the −Z-axis directional side in FIG. 5) of the apparatus.

The roller driving mechanism 78 causes a driving force from the roller driving motor 80 on the rear side (which is the +Y-axis directional side in FIG. 5) of the apparatus main body 12 to be transmitted to the transport driving roller 38 through a plurality of gears. Subsequently, the roller driving mechanism 78 causes the driving force from the roller driving motor 80 to be transmitted, through a plurality of gears, from a gear 82*a* for driving the transport driving roller 38 to a gear 82*b* on the front side (which is the −Y-axis directional side in FIG. 5) of the apparatus main body 12. As a result, the discharge driving roller 56 is driven. In other words, the roller driving mechanism 78 functions as a power transmission mechanism for transmitting power from the roller driving motor 80 to both the transport driving roller 38 and the discharge driving roller 56 as means for transporting the paper sheet P.

Routing of Cable

Next, routing of cable 72, as one of cables, extending from the carriage 44 to the control substrate 50 will be described with reference to FIGS. 6 to 10 and FIGS. 14 and 15. The cable 72 in this embodiment is constituted of, for example, a flexible flat cable (FFC) performing transceiving of data.

First, routing of the cable 72 in a state where the carriage 44 is located in the end portion on the −X-axis directional side in the movement area L2 will be described. One end of the cable 72 is connected to the rear side (which is the +Y-axis directional side in FIG. 6) of the carriage 44, as illustrated in FIG. 6. The cable 72 extending from the rear side extends from the rear side (which is the +Y-axis directional side in FIG. 6) to the front side (which is the −Y-axis directional side in FIG. 6), along the end portion on the −X-axis directional side of the carriage 44. The cable 72 routed to the front side (which is the −Y-axis directional side in FIG. 6) of the carriage 44 is disposed on the guiding surface 62*a* (in other words, the +Y-axis directional side in FIGS. 6 and 7) of the guide frame 62, as illustrated in FIGS. 6 and 7. Then, the cable 72 extends in the X-axis direction, toward the end portion on the +X-axis directional side (see FIG. 14).

The cable 72 disposed on the guiding surface 62*a* of the guide frame 62 is held on the guiding surface 62*a*, by the cable fixing hooks 62*b* and 62*b* which are provided at two positions in the guiding surface 62*a* (see FIG. 14).

Next, when the carriage 44 moves in the X-axis direction, for example, the carriage 44 moves from the end portion on the −X-axis directional side to the end portion on the +X-axis directional side, the cable 72 follows the movement of the carriage 44 in such a manner that the cable 72 is bent, in accordance with the movement of the carriage 44 in the X-axis direction, within the movement area L2 of the carriage 44, at the cable fixing hook 62*b*, functioning as a fulcrum, which is located in the X-axis directional central portion of the guiding surface 62*a* of the guide frame 62, as illustrated in FIG. 15.

In other words, a part of the cable 72 held on the guiding surface 62*a* of the guide frame 62, which is the portion extending from the cable fixing hook 62*b* in the X-axis directional central portion of the guiding surface 62*a* to the end portion on the −X-axis directional side can be separated from the guiding surface 62*a* to the +Y-axis directional side, as illustrated in FIG. 15. Accordingly, the cable 72 can be bent in the movement area L2 of the carriage 44, in accordance with the movement of the carriage 44. As a result, the cable 72 can follow the movement of the carriage 44.

In the +X-axis directional side of the guide frame 62, the cable 72 is drawn out to the front side (which is the −Y-axis directional side in FIG. 7) through an opening (not illustrated) in the end portion on the +X-axis directional side of the guide frame 62, as illustrated in FIGS. 8A and 8B. Subsequently, the cable 72 passes through the ferrite core 76 (see FIG. 8B) and is bent to the −X-axis directional side. Next, the cable 72 is adhered, using, for example, an adhesive member (not illustrated), to the mounting portion 70*b* of the guiding member 70.

The cable 72 is bent to the +Z-axis directional side, in the mounting portion 70*b* and extends to the guiding surface 70*a*. Subsequently, the direction of the cable 72 is changed, on the guiding surface 70*a*, to the +Y-axis direction and the cable 72 is routed, along the guiding surface 70*a*, from the −Y-axis directional side to the +Y-axis directional side in FIG. 8B. The cable 72 is adhered, using, for example, an adhesive member (not illustrated), to the guiding surface 70*a*. The bent portion 74 guides the cable 72, along the Y-axis direction.

Next, the cable 72 is routed to the rear side (which is the +Y-axis directional side in FIG. 7), in the end portion of the +X-axis directional side of the printer 10, as illustrated in FIGS. 7 and 9. Then, the direction of the cable 72 is changed and the cable 72 extends to the −X-axis directional side. Subsequently, the direction of the cable 72 is changed in the central portion of the printer 10 in the X-axis direction such that the cable 72 is directed to the lower side, that is, the −Z-axis directional side, of the printer 10. Next, the other end of the cable 72 is connected to the control substrate 50 in the lower surface of the printer 10, as illustrated in FIG. 10.

A cable 84 of which one end is connected to the end portion of the +X-axis directional side of the operation portion 18 extends from the operation portion 18 to the +X-axis directional side and the cable 84 is directed to the guiding surface 70*a* of the guiding member 70, as illustrated in FIGS. 7 to 10. The description of routing of the cable 84 from the guiding surface 70*a* to the control substrate 50 is similar to that of the cable 72 and will not be repeated. The other end of the cable 84 is connected to the control substrate 50.

Layout of Guiding Member in Apparatus Main Body

Next, the arrangement of the cable 72 disposed on both the guiding member 70 and the guiding surface 70*a*, in the apparatus main body 12, will be described with reference to FIGS. 11 to 13, while illustrating the relationship between the cable 72 and other members.

In an apparatus height direction, that is, the Z-axis direction in FIG. 11, the cable 72 disposed on both the guiding member 70 and the guiding surface 70*a* is mounted on the upper portion of the main frame 60, as illustrated in FIG. 11. In other words, the cable 72 disposed on both the guiding member 70 and the guiding surface 70*a* is located in a portion between the main frame 60 and the upper surface 14*a* of the housing 14.

The positions of both the guiding member 70 and the cable 72 are arranged in a state such that both the guiding member 70 and the cable 72 overlap, in the Z-axis direction (the apparatus height direction), with at least a part of an area in which the operation portion 18 is provided. In other words, it is possible to reduce the size of the printer 10 in the Z-axis direction, compared to in the case where the guiding member 70, the cable 72, and the operation portion 18 are arranged, in a stacked manner, in the Z-axis direction (the apparatus height direction). As a result, it is possible to achieve a reduction in the size of the printer 10.

The positions of both the guiding member 70 and the cable 72 are arranged in a state in which both the guiding member 70 and the cable 72 overlap, in the Z-axis direction (the apparatus height direction), with at least a part of a pivot shaft 86 of the cover portion 16, specifically, the upper cover portion 22, as illustrated in FIG. 12.

In other words, since both the guiding member 70 and the cable 72 overlap, in the Z-axis direction, with at least a part of the cover portion 16, it is possible to reduce the size of the printer 10 in the apparatus height direction, compared to in the case where both the guiding member 70 and cable 72 are disposed below the cover portion 16. As a result, it is possible to achieve a reduction in the size of the printer 10.

When the carriage 44 is moved to the end portion on the +X-axis directional side, as illustrated in FIG. 13, both the guiding member 70 and the cable 72 are disposed, in the Z-axis direction, in a space between an upper surface 44*a* of the carriage 44 and the upper surface 14*a* of the housing 14.

In other words, when the carriage 44 is moved to the end portion on the +X-axis directional side in the movement area L2, both the guiding member 70 and the cable 72 are not disposed, in the X-axis direction, outside the movement area L2 of the carriage 44 and are disposed above the carriage 44. Accordingly, it is possible to reduce the size (the width) of the printer 10 in the X-axis direction. As a result, it is possible to achieve a reduction in the size of the printer 10.

When the carriage 44 is moved to the end portion on the +X-axis directional side, the roller driving mechanism 78 overlaps, in the X-axis direction, with at least a part of the installation area of the carriage 44. Furthermore, the roller driving mechanism 78 is located, in the Z-axis direction, below the carriage 44 and overlaps at least a part of the installation area of the carriage 44.

In other words, when the carriage 44 is moved to the end portion in the movement area L2, the guiding member 70, the cable 72, and the roller driving mechanism 78 are not located, in the X-axis direction, outside the movement area L2 of the carriage 44, in other words, on the +X-axis directional side in the apparatus. In this case, the guiding member 70, the cable 72, and the roller driving mechanism 78 are located inside the movement area L2, in other words, on the −X-axis directional side in the apparatus. Accordingly, it is not necessary to provide, outside the movement area L2 of the carriage 44, a space to arrange the guiding member 70, the cable 72, and the roller driving mechanism 78. Thus, it is possible to reduce the size of the printer 10 in the X-axis direction. As a result, it is possible to achieve a reduction in the size of the printer 10.

A summary of the above description follows. Since the cable 72 connected to the control substrate 50 passes across the upper side (that is, the +Z-axis directional side) of at least a part of the movement area L2 of the carriage 44, it is not necessary to provide, outside the movement area L2 of the carriage 44 in the X-axis direction, a space for allowing the cable 72 to pass therethrough. As a result, it is possible to reduce the size of the apparatus in the X-axis direction, that is, the width direction of the printer 10.

In addition, the guiding member 70 which extends in the Y-axis direction and guides the cable 72 is provided above the movement area L2 of the carriage 44, at a position which is located, in the X-axis direction, outside the transporting path of the paper sheet P. In other words, the guiding member 70 can reliably hold the cable 72, in the upper side of the movement area L2 of the carriage 44. As a result, it is possible to reduce the possibility that the cable 72 may fall down into the movement area L2 of the carriage 44 and thus may hinder the movement of the carriage 44.

Modification Examples of Embodiment (1) In the embodiment, the guiding member 70 is disposed, in the X-axis direction, on the +X-axis directional side. However, the guiding member 70 may be provided on the −X-axis directional side. Furthermore, in the X-axis direction, the guiding member 70 may be provided in an area outside the transporting path area L1 of the paper sheet P, at a position away from the end portion on the +X-axis directional side or the end portion on the −X-axis directional side.

(2) In the embodiment, the roller driving mechanism 78 is constituted of a gear group having a plurality of gears. However, power from the roller driving motor 80 may be transmitted to both the transport driving roller 38 and the discharge driving roller 56 which are means for transporting the paper sheet P, using belt driving mechanisms.

A summary of the above description follows. The printer 10 of the embodiment includes the control substrate 50 for controlling the recording operations relative to the paper sheet P, the cable 72 as the "first cable" connected to the control substrate 50, and the carriage 44 capable of moving in the X-axis direction in accordance with the control of the control substrate 50. The cable 72 passes across the upper side of at least a part of the movement area L2 of the carriage 44, in the X-axis direction.

In addition, the guiding member 70 which extends in the Y-axis direction and guides the cable 72 is provided above the movement area L2 of the carriage 44, at a position outside the transporting path area L1 of the paper sheet P. The guiding member 70 is provided, in the X-axis direction, in the end portion in the movement area L2 of the carriage 44.

The carriage 44 includes the recording head 46 for discharging ink onto the paper sheet P. The cable 72 guided by the guiding member 70 is electrically connected to the recording head 46 of the carriage 44. The printer 10 includes the operation portion 18 which sends commands to the control substrate 50. Both the cable 72 and the guiding member 70 overlap, in the Z-axis direction, with at least a part of the installation area of the operation portion 18.

The printer 10 includes the apparatus main body 12 provided with the operation portion 18 and the cover portion 16 which is pivotally mounted on the apparatus main body 12. The state of the cover portion 16 can be switched between the open state where the operation portion 18 is exposed to the area above the apparatus main body 12 and the closed state where the cover portion 16 covers the operation portion 18. Both the cable 72 and the guiding member 70 overlap, in the Z-axis direction, with at least a part of the cover portion 16.

The printer 10 includes the roller driving mechanism 78 which transmits power from the roller driving motor 80, to both the transport driving roller 38 and the discharge driving roller 56 for transporting the paper sheet P. When the carriage 44 is moved to the end portion on the +X-axis directional side in the movement area L2, the roller driving mechanism 78 is located below the carriage 44 and the guiding member 70 is located above the carriage 44. As a result, the roller driving mechanism 78, the carriage 44, and the guiding member 70 overlap each other.

The guiding member 70 is located above the carriage driving motor 52 for driving the carriage 44. The bent portion 74 is formed, in the X-axis direction, in the end portion on the −X-axis directional side of the guiding member 70 and the bent portion 74 extends in the Y-axis direction.

The printer 10 includes the main frame 60 and the guide frame 62. The main frame 60 has the guide frame 61 mounted thereon and the carriage 44 slides on the guide frame 61. The guide frame 62 has the guiding surface 62*a* to which the cable 72 is fixed. The guiding member 70 connects the main frame 60 and the guide frame 62.

Embodiment 2

Figure 16:
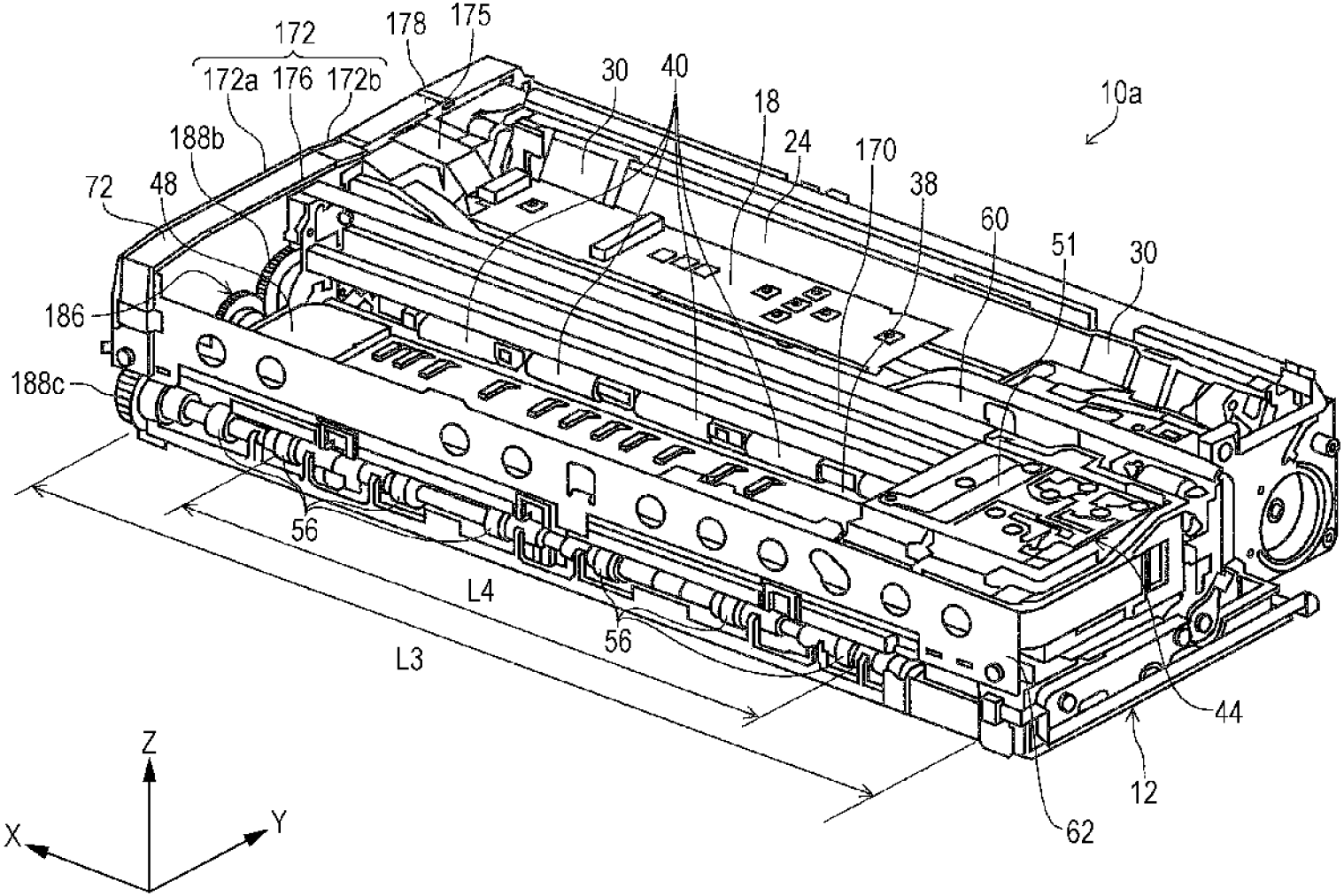
FIG. 16 is a perspective view illustrating the internal structure of the printer.
Figure 17:
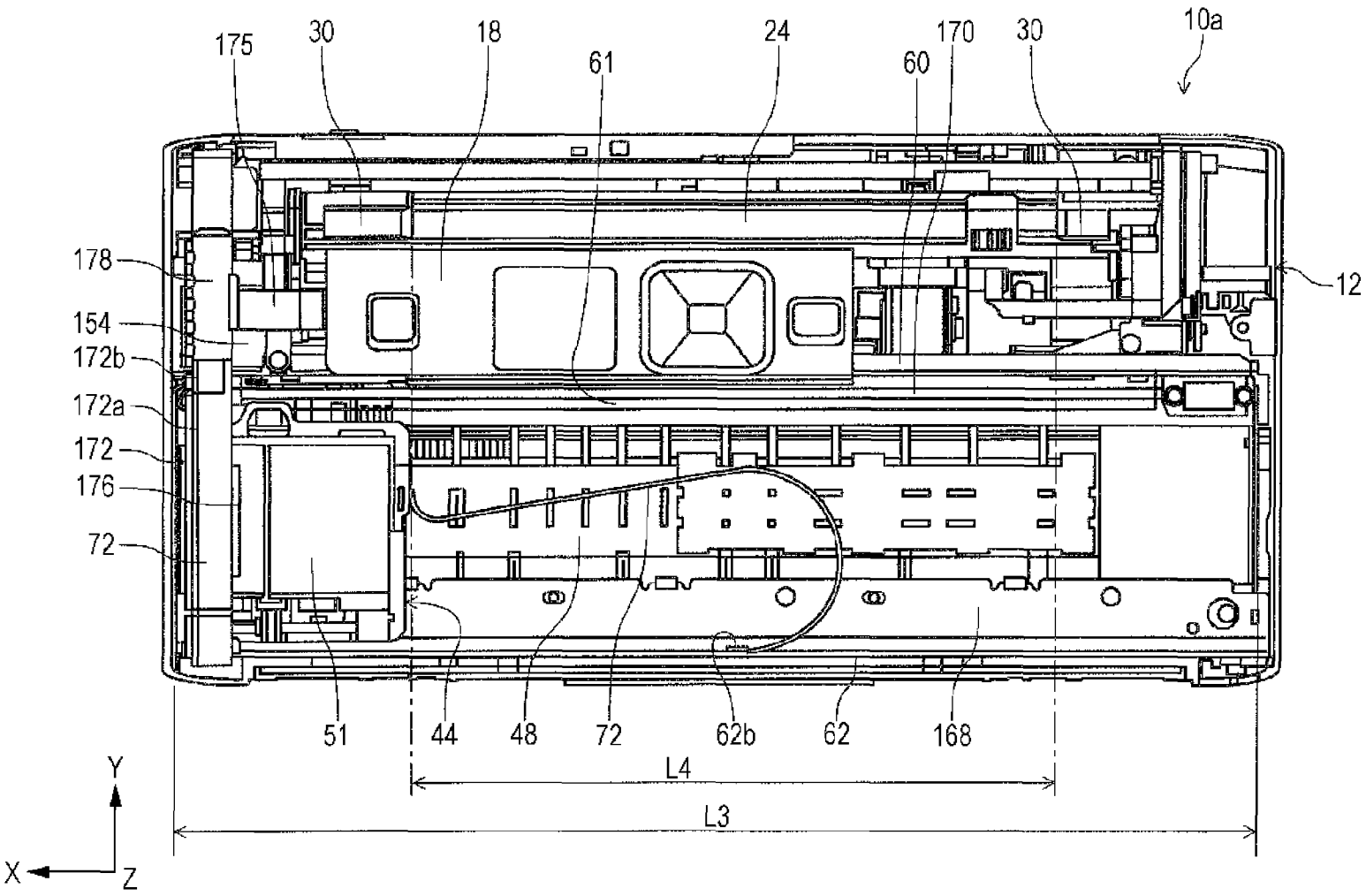
FIG. 17 is a plan view illustrating the carriage movement area.
Figure 18:
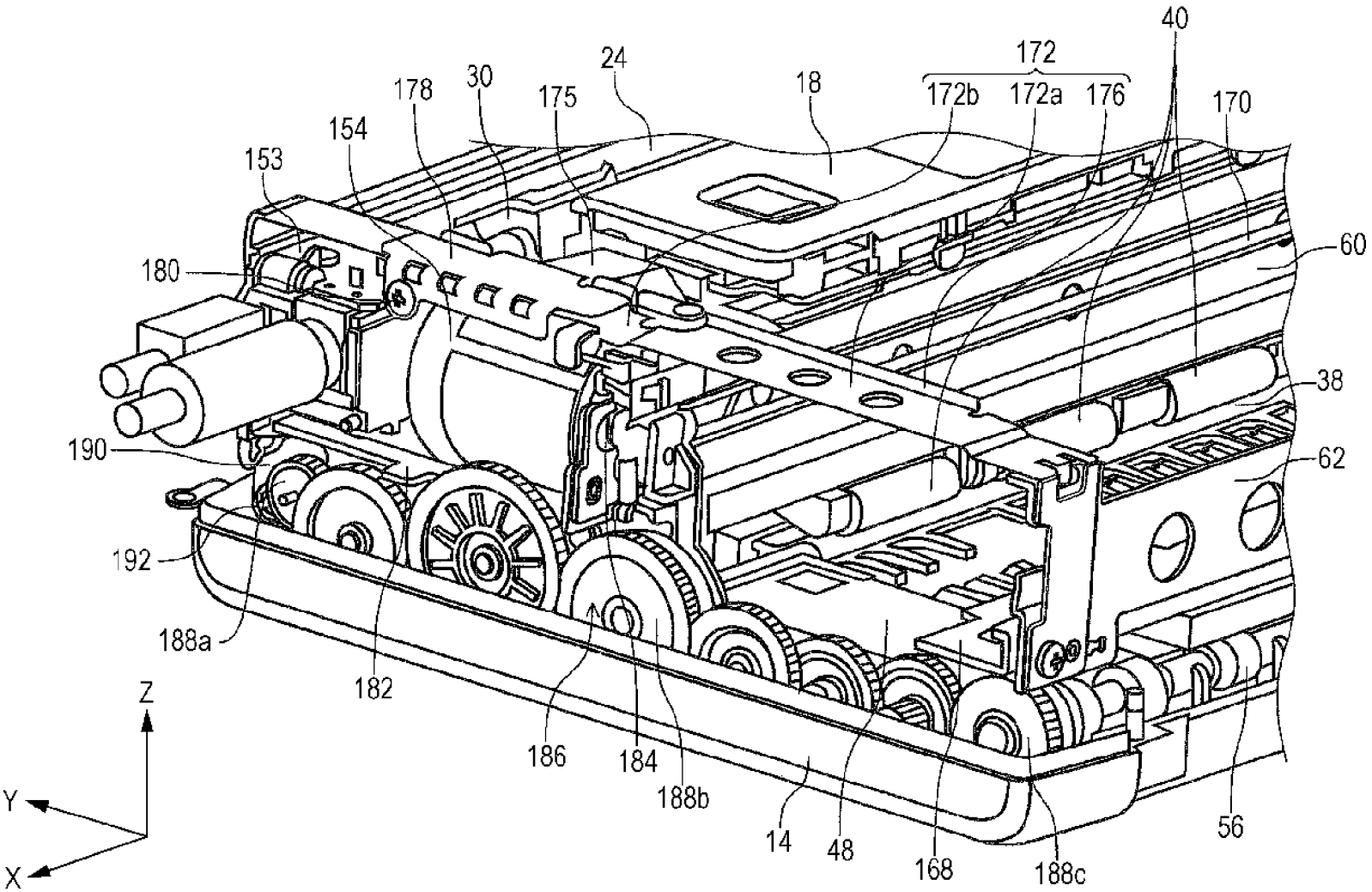
FIG. 18 is a perspective view illustrating an end portion which is located on a side opposite to a home position in the carriage movement area in the printer.
Figure 19:
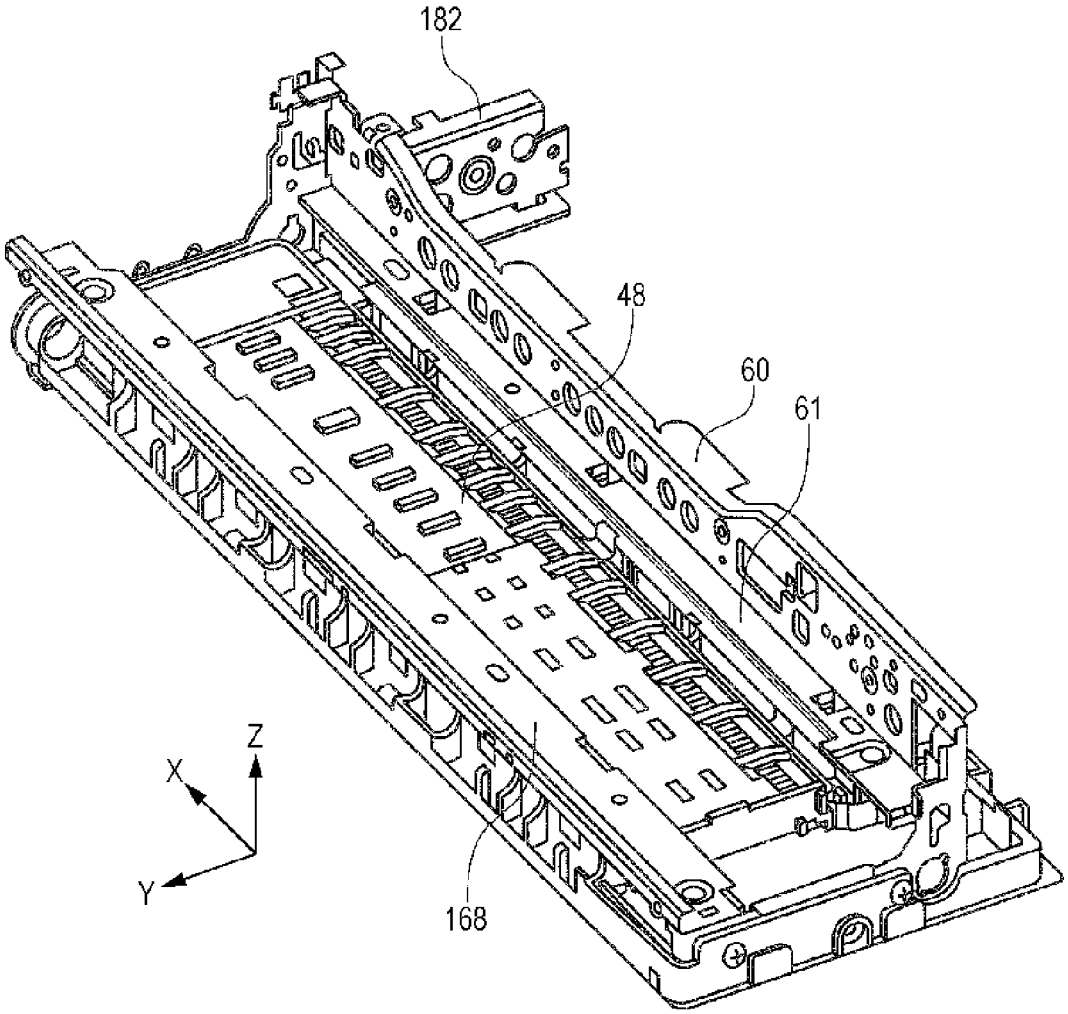
FIG. 19 is a perspective view illustrating the structure of a frame constituting the printer.
Figure 20:
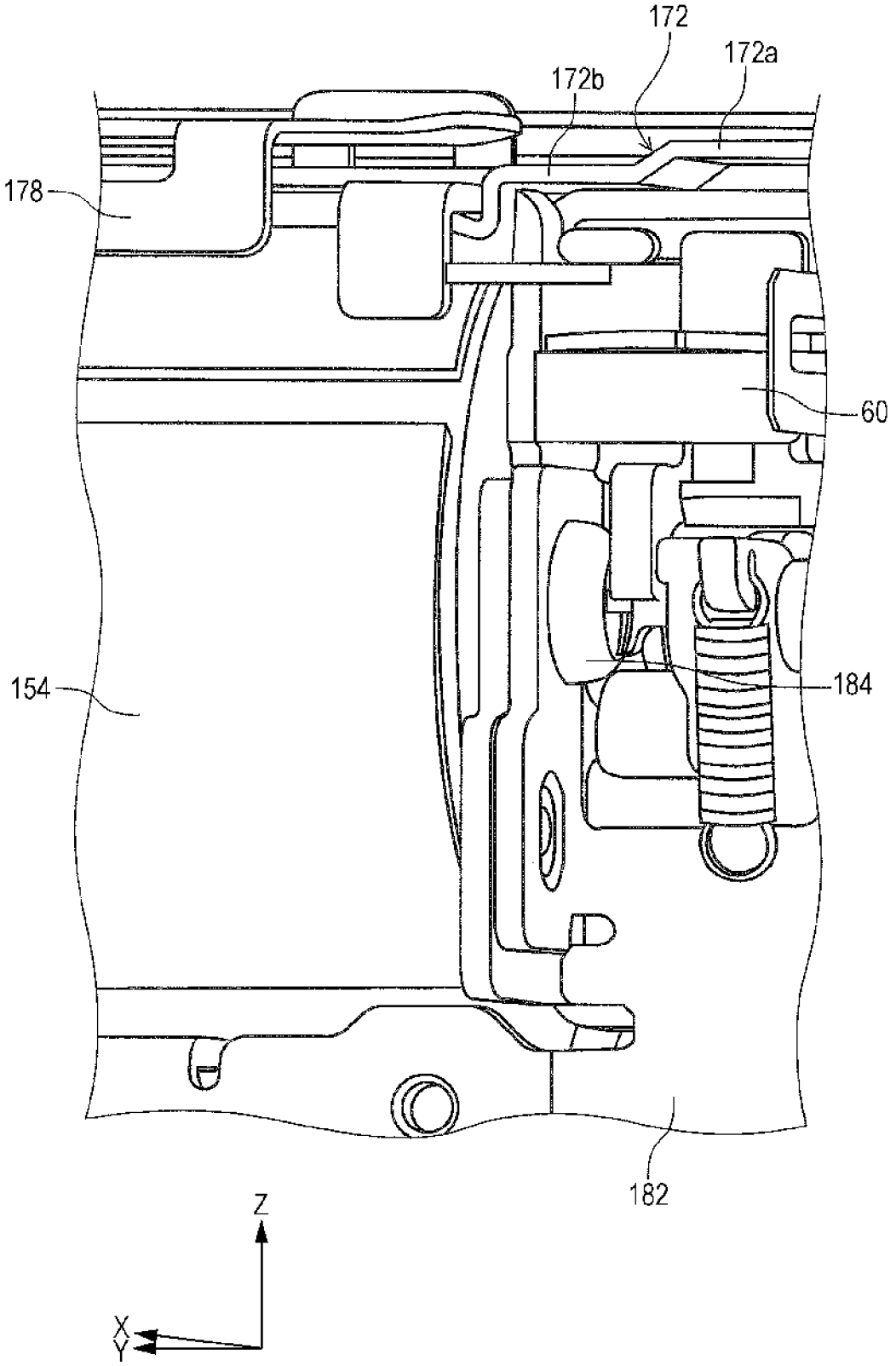
FIG. 20 is a perspective view illustrating a connection state between a rear-side main frame and a side frame.
Figure 21:
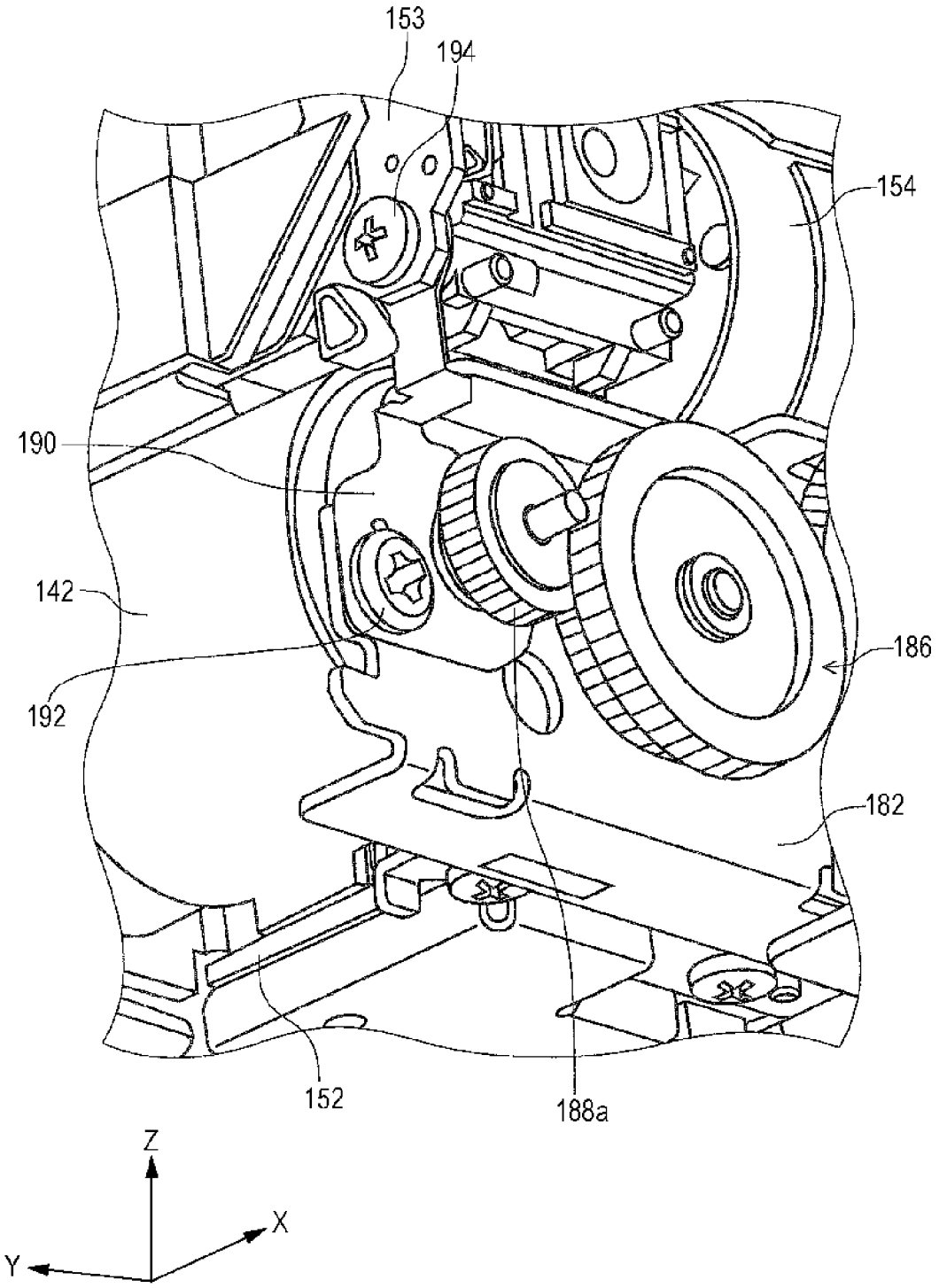
FIG. 21 is a perspective view illustrating a connection state between the side frame and a control substrate.
Figure 22:
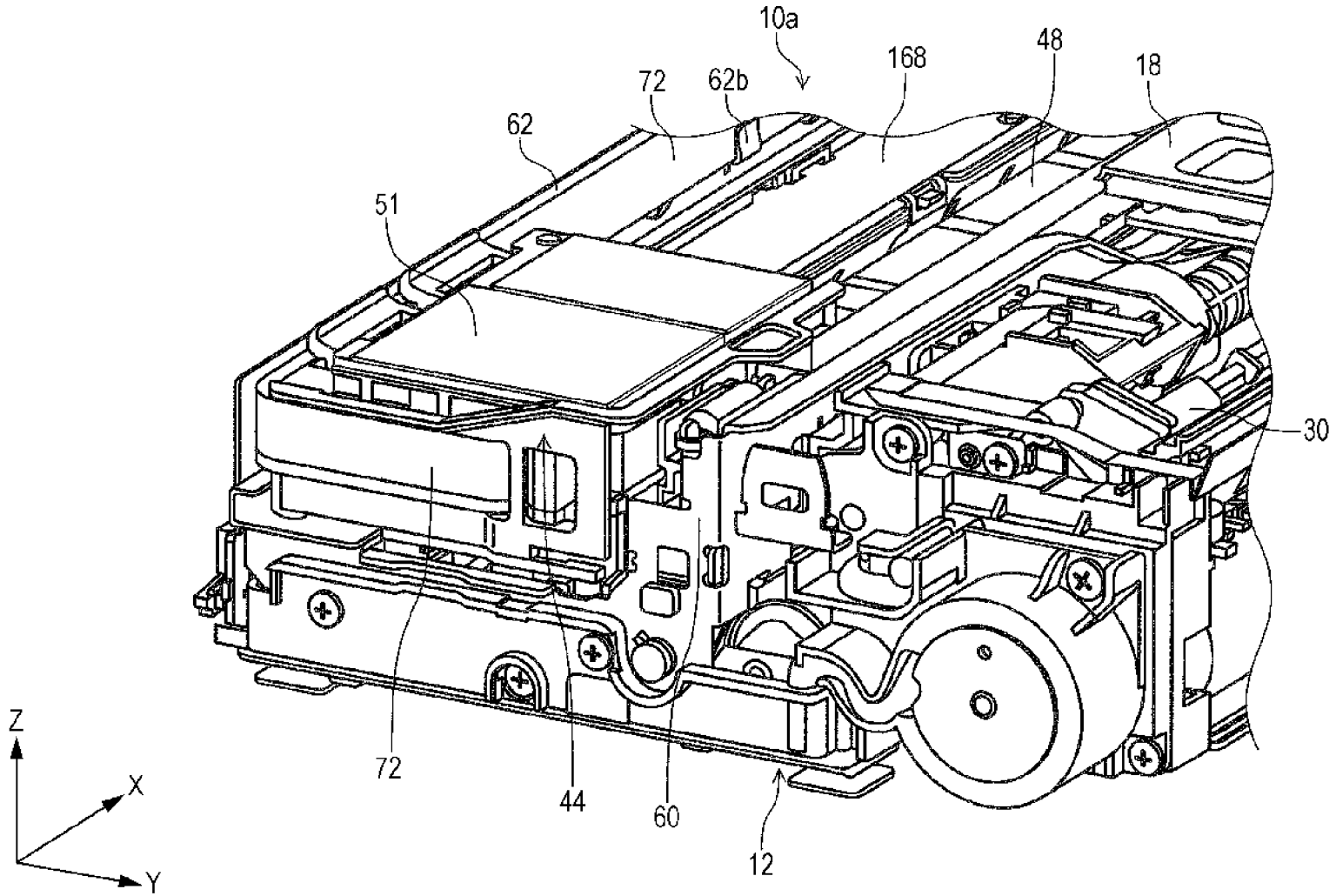
FIG. 22 is a perspective view illustrating an end portion which is located on the home position side in the carriage movement area in the printer.

FIG. 16 is a perspective view illustrating the internal structure of a printer 10*a* of Embodiment 2 and FIG. 17 is a plan view illustrating a carriage movement area L3. FIG. 18 is a perspective view illustrating an end portion which is located on a side opposite to a home position in the carriage movement area L3 in the printer 10*a*. FIG. 19 is a perspective view illustrating the structure of a frame constituting the printer 10*a* and FIG. 20 is a perspective view illustrating a connection state between a rear guide frame and a side frame. FIG. 21 is a perspective view illustrating a connection state between the side frame and a control substrate and FIG. 22 is a perspective view illustrating an end portion which is located on the home position side in the carriage movement area L3 in the printer 10*a*.

Figure 23:
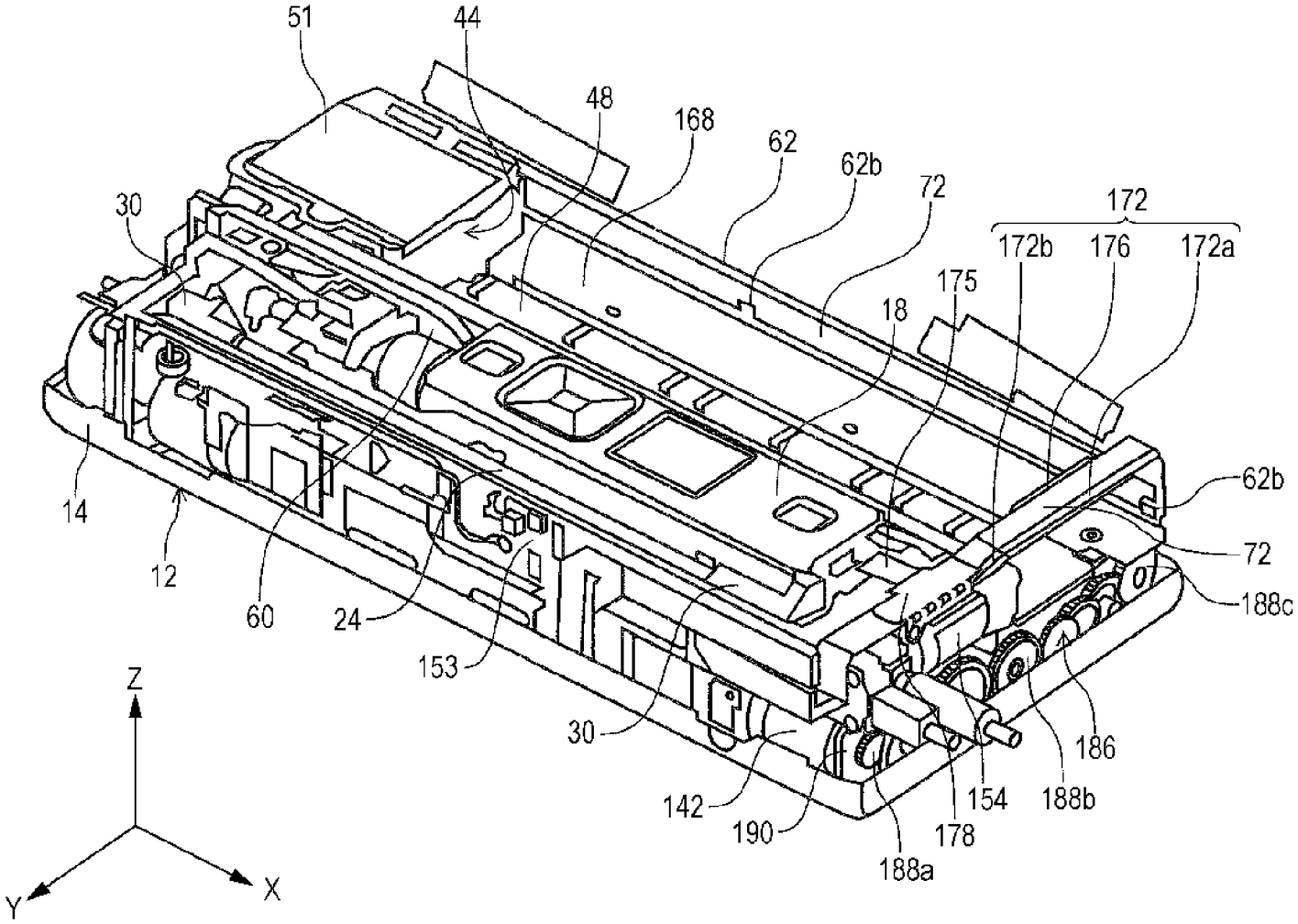
FIG. 23 is a perspective view of the internal structure of the printer, when viewed from the rear side.
Figure 24A:
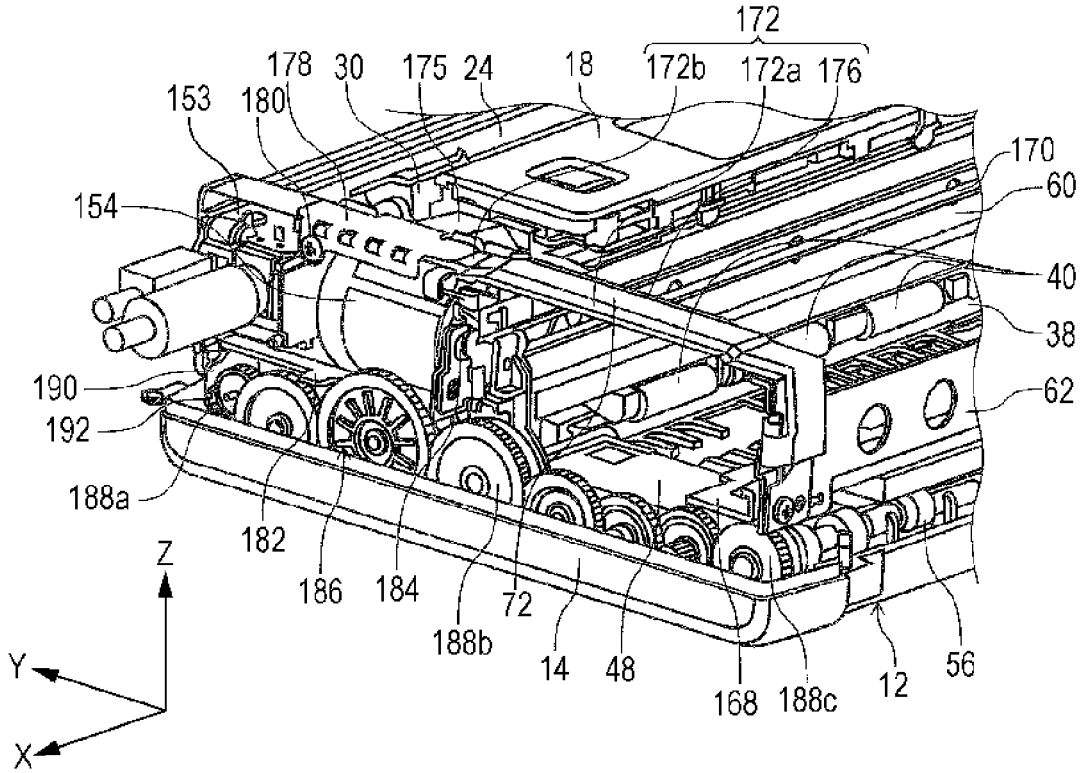
FIG. 24A is a perspective view illustrating the arrangement of both the guiding member and the cable, in the end portion on the side opposite to the home position in the carriage movement area.
Figure 24B:
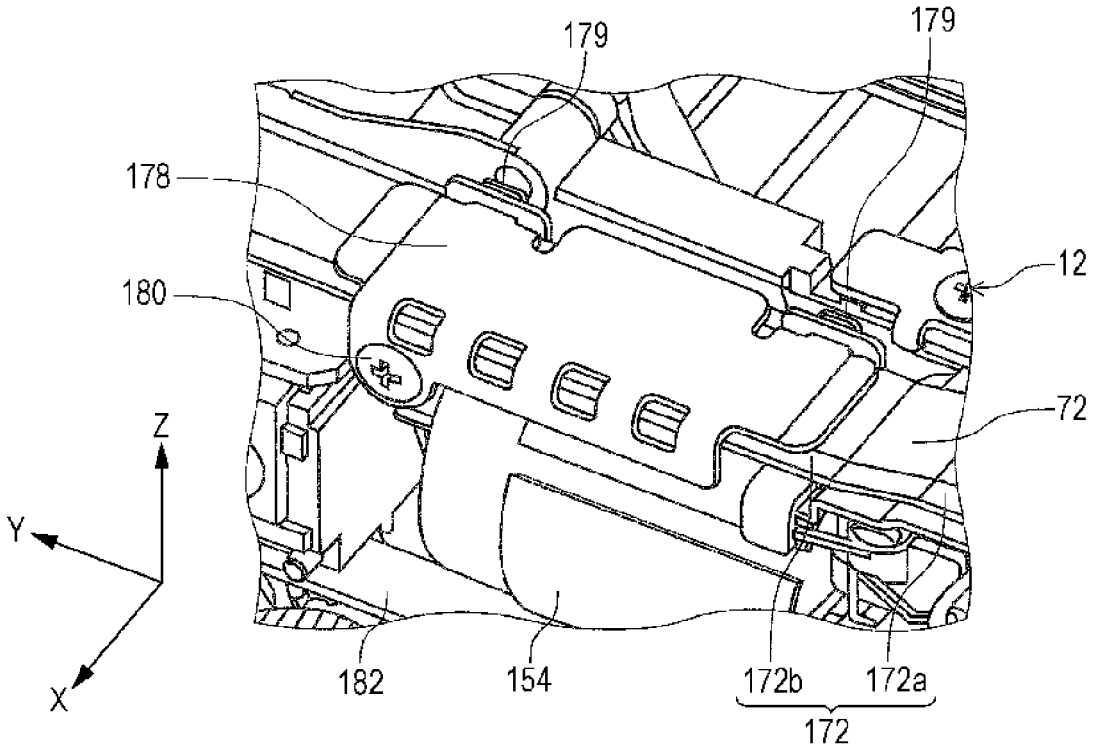
FIG. 24B is a perspective view illustrating a metallic member mounted on the guiding member.
Figure 25:
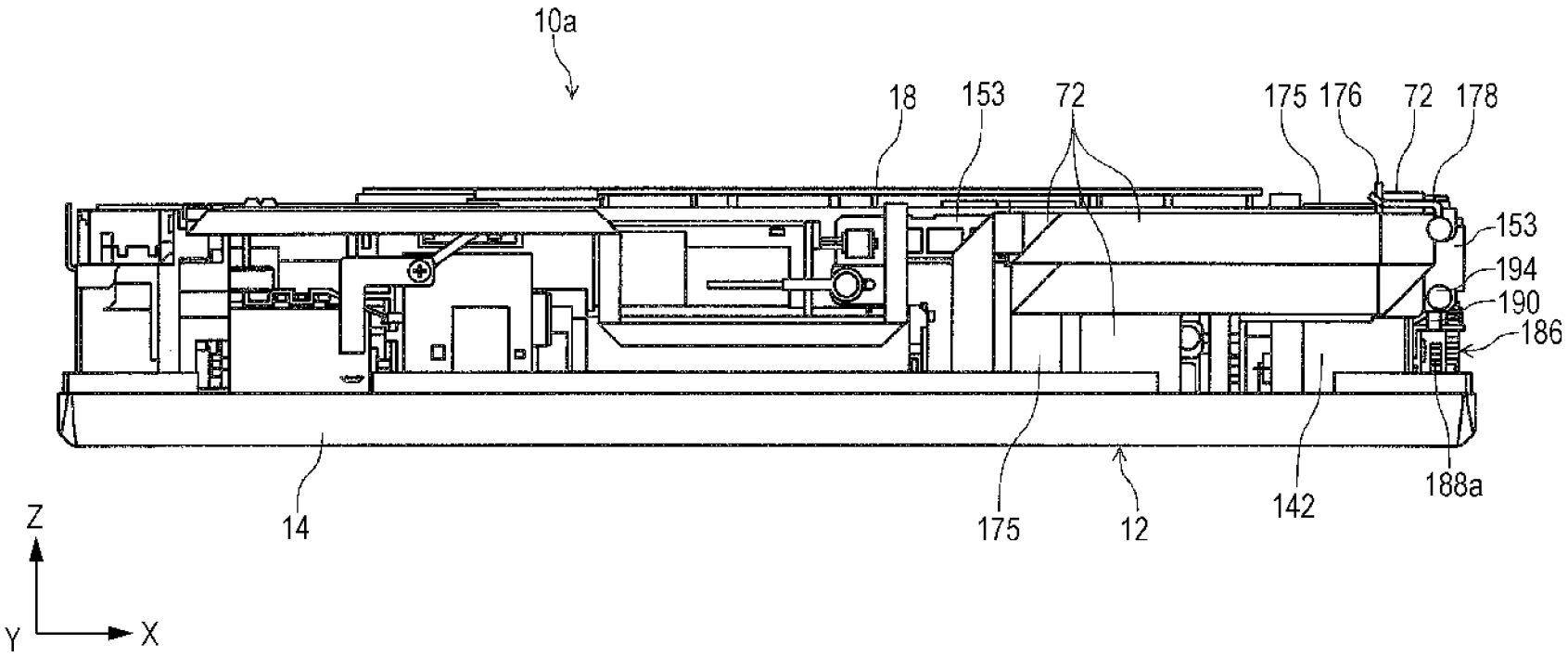
FIG. 25 is a rear view illustrating a cable routing state in the rear side of the printer.
Figure 26:
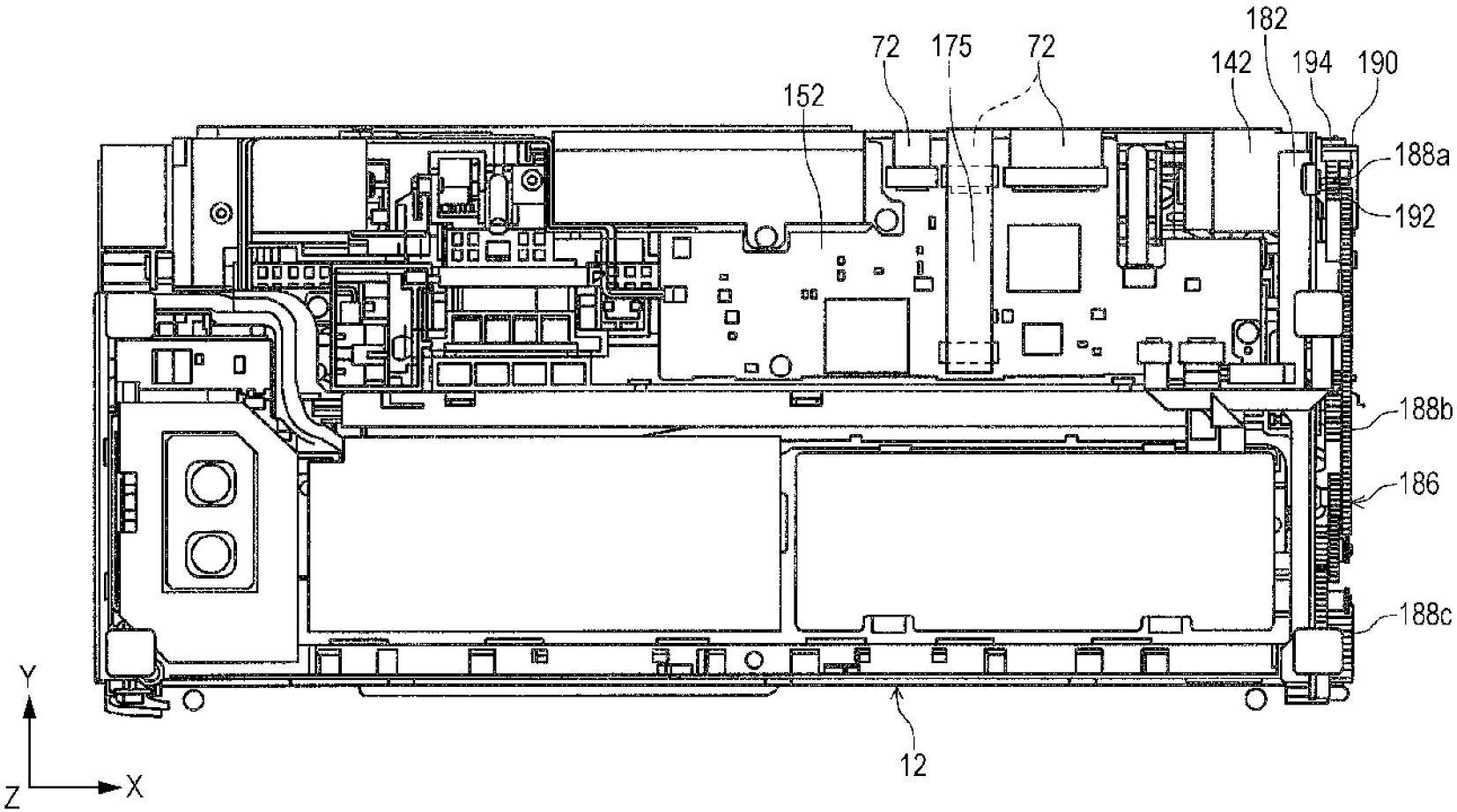
FIG. 26 is a plan view illustrating a lower surface of the apparatus main body in the printer.
Figure 27:
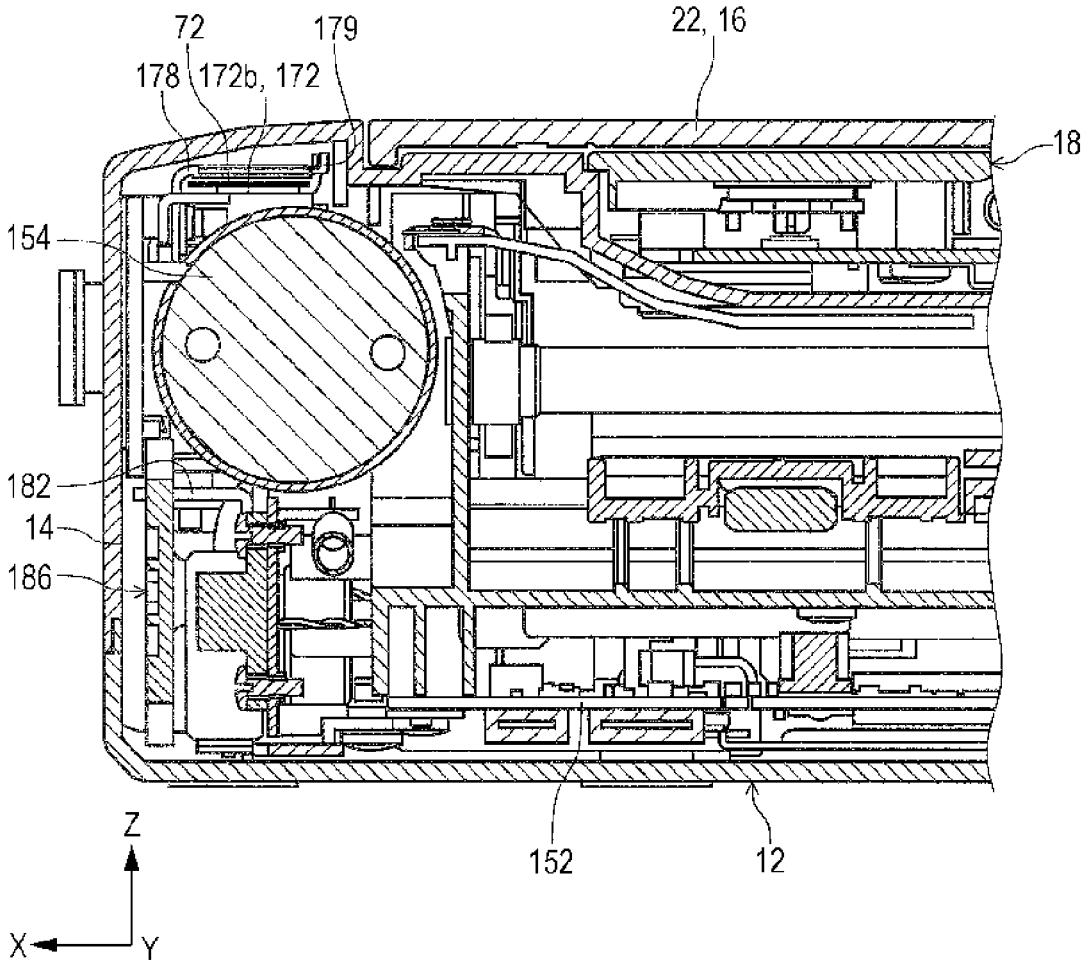
FIG. 27 is a cross-sectional view illustrating the arrangement of both the guiding member and the cable, in the end portion on the side opposite to the home position in the carriage movement area.

FIG. 23 is a perspective view of the internal structure of the printer 10*a*, when viewed from the rear side. FIG. 24A is a perspective view illustrating the arrangement of both the guiding member and the cable, in the end portion on the side opposite to the home position in the carriage movement area L3 and FIG. 24B is a perspective view illustrating a metallic member mounted on the guiding member. FIG. 25 is a rear view illustrating a cable routing state in the rear side of the printer 10*a*. FIG. 26 is a plan view illustrating a lower surface of the apparatus main body in the printer 10*a*. FIG. 27 is a cross-sectional view illustrating the arrangement of both the guiding member and the cable, in the end portion on the side opposite to the home position in the carriage movement area L3.

In the X-Y-Z coordinate system used for illustration in each drawing, the X direction is the scanning direction of the recording head and the apparatus width direction, the Y direction is the depth direction of the recording apparatus and the paper transporting direction, and the Z direction is the apparatus height direction. Furthermore, in each drawing, the −X-axis directional side is set to a home position side relating to the carriage, the −Y-axis direction side is the front side of the apparatus, and the +Y directional side is the rear side of the apparatus.

Schematic Configuration of Printer

Components of the printer 10*a* as an example of the recording apparatus of Embodiment 2 will be described with reference to FIGS. 1 and 2. The printer 10*a* includes the apparatus main body 12 (see FIG. 16), the housing 14, the cover portion 16, and the operation portion 18. The housing 14 functions as a "case body" for covering the periphery of the apparatus main body 12 and forms the appearance of the printer 10*a*. The cover portion 16 can be open or closed with respect to the apparatus main body 12. When the cover portion 16 is open, the operation portion 18 is exposed to the area above the apparatus main body 12.

The cover portion 16 includes the front cover portion 20 and the upper cover portion 22. The front cover portion 20 is pivotally mounted on the upper cover portion 22. The upper cover portion 22 is pivotally mounted on the apparatus main body 12.

In a state where the cover portion 16 is closed with respect to the apparatus main body 12 (see FIG. 1), the front cover portion 20 constitutes a part of the front surface of the housing 14. Furthermore, in a state where the cover portion 16 is closed, the upper cover portion 22 constitutes a part of the upper surface 14*a* of the housing 14.

Meanwhile, when the cover portion 16 pivots, with respect to the apparatus main body 12, in the counter-clockwise direction in FIG. 2, the cover portion 16 moves from the front side (which is the −Y-axis directional side in FIG. 2) of the apparatus to the rear side (which is the +Y-axis directional side in FIG. 2) of the apparatus. The state of the cover portion 16 is switched to the open state illustrated in FIG. 2. In this case, the front cover portion 20 pivots with respect to the upper cover portion 22, and thus both the inner surface 20*a* of the front cover portion 20 and the inner surface 22*a* of the upper cover portion 22 form one surface as the inner surface of the cover portion 16. In this embodiment, when the cover portion 16 is in a state (illustrated in FIG. 2) where the cover portion 16 is open with respect to the apparatus main body 12, the inner surface of the cover portion 16 functions as the mounting surface 16*a* for the paper sheet P as a "medium".

Subsequently, when the state of the cover portion 16 is switched from the closed state (see FIG. 1) to the open state, as illustrated in FIG. 2, both the operation portion 18 and the paper supply port 24 are exposed to the area above the apparatus main body 12 and the discharge port 26 is exposed to the side in front of the apparatus main body 12. The operation portion 18 includes a power button, a print setting button, a display panel, and the like for operating the printer 10*a*.

When the paper sheet P is mounted on the mounting surface 16*a* of the cover portion 16, the paper sheet P is supplied from the mounting surface 16*a* to the inner portion of the apparatus main body 12, through the paper supply port 24. The paper sheet P supplied, through the paper supply port 24, from the mounting surface 16*a* to the inner portion of the apparatus main body 12 is subjected to recording by the recording portion 42 described below, and then the paper sheet P is discharged through the discharge port 26, to the side (which is the −Y-axis directional side in FIG. 2) in front of the apparatus.

Next, the details of the components on the transporting path of a paper sheet will be described with reference to FIG. 3. The right side (the rear side of the apparatus) of the paper of FIG. 3 is the upstream side of the feeding path and the left side (the front side of the apparatus) of the paper is the downstream side of the feeding path. The broken line in FIG. 3 illustrates the transporting path PR of the paper sheet P.

The paper supply portion 28 is provided, as a feeding portion, on the upstream side of the feeding path. The paper supply portion 28 feeds the paper sheet, from the mounting surface 16*a* of the cover portion 16 in the open state with respect to the housing 14 to the downstream side of the feeding path. The paper supply portion 28 includes the paper supply port 24, a pair of paper guiding portions 30, the paper supporting portion 32, and the feeding roller 34. The pair of paper guiding portions 30 are provided in the paper supply port. The paper supporting portion 32 supports at least a part of the paper sheet inserted through the paper supply port 24. The feeding roller 34 is disposed facing the paper supporting portion 32. Both the cover portion 16 and the paper supporting portion 32 support the paper sheet P, in a state where the paper sheet P is inclined.

The paper supporting portion 32 has a shape inclined downward toward the left side of the paper sheet in FIG. 3, that is, the downstream side of the transporting path. In addition, the feeding roller 34 can oscillate in the contact/separation direction, with respect to the paper sheet P mounted on the paper supporting portion 32. When the feeding roller 34 is displaced in the direction in which the feeding roller 34 moves closer to the paper supporting portion 32, the feeding roller 34 comes into contact with the uppermost paper sheet of the paper sheets P mounted on the paper supporting portion 32 and the feeding roller 34 feeds the uppermost paper sheet P to the downstream side of the feeding path.

The transporting portion 36 is provided on the downstream side of the paper supply portion 28. The transporting portion 36 includes the transport driving roller 38 and the transport driven roller 40. The transport driving roller 38 is pivoted by a roller driving motor 142 (see FIG. 21). The transporting portion 36 transports the paper sheet P fed from the paper supply portion 28 to the downstream side in the transporting direction, in a state where the paper sheet P is nipped between the transport driving roller 38 and the transport driven roller 40. The recording portion 42 is provided on the downstream side of the transporting portion 36.

The recording portion 42 includes the carriage 44, the recording head 46, and the platen 48. The recording head 46 is provided on the bottom portion of the carriage. The platen 48 faces the recording head and functions as a support portion for supporting a medium. The recording head 46 faces the medium supported by the platen 48. An ink cartridge 51 is detachably mounted on the carriage 44 (see FIGS. 2 and 16). The ink cartridge 51 supplies ink to the recording head 46.

Although not illustrated, both a linear scale and an encoder sensor are provided, in the rear surface of the carriage 44, as means for detecting the position of the carriage 44 in the movement area L3 of the carriage 44. The linear scale extends in the apparatus width direction and a plurality of slits are provided in the linear scale, with constant intervals in the apparatus width direction. When the carriage 44 moves, the encoder sensor reads the slits of the linear scale and transmits the read information to control substrates 152 and 153. The control substrates 152 and 153 detect the position of the carriage 44 in the movement area L3, based on the information.

The carriage 44 is driven to reciprocate in the main scanning direction (which is the front-back direction of the paper sheet of FIG. 3, that is, the X-axis direction) as the "predetermined movement direction", by a carriage driving motor 154 (see FIG. 18) as a "drive source" controlled by the control substrates 152 and 153 (see FIGS. 26 and 27) as a "controller" in the apparatus main body 12. In addition, the distance (the gap) between the recording surface of a medium and the head surface of the recording head 46 is set in such a manner that the platen 48 supports the paper sheet P from below.

The discharging portion 54 is provided on the downstream side of the recording portion 42 in the transporting direction. The discharging portion 54 includes the discharge driving roller 56 and the discharge driven roller 58. The paper sheet P subjected to recording by the recording portion 42 is discharged to the side in front of the apparatus through the discharge port 26 formed on the front surface of the apparatus, in a state where the paper sheet P is nipped between the discharge driving roller 56 and the discharge driven roller 58. Furthermore, the discharge driving roller 56 is rotated by a roller driving motor 142 (see FIG. 21).

The control substrates 152 and 153 (see FIGS. 26 and 27) control operations, such as a feeding operation, a transporting operation, a discharging operation, and a recording operation relating to a paper sheet, necessary for performing recording on the paper sheet P in the transporting portion 36, the recording portion 42 and the discharging portion 54 of the printer 10*a*, in accordance with a command input from the operation portion 18. In addition, the control substrates 152 and 153 also control rotation of both the carriage driving motor 154 (see FIG. 18) and the roller driving motor 142 (see FIG. 21). The configurations of both the control substrate 152 and the control substrate 153 will be described below.

Configuration of Apparatus Main Body

The configurations of the apparatus main body 12 will be described with reference to FIGS. 16 to 21. The description of routing of both the cable 72 as a "first cable" and a cable 175 as a "second cable" in the apparatus main body 12 will follow the description of the configuration of the apparatus main body 12. Also, the cables 72 and 175 will be described below.

The apparatus main body 12 includes the main frame 60 as a "first frame" and the guide frame 62 as a "third frame". The main frame 60 extends in the apparatus width direction (which is the X-axis direction in FIG. 16). The guide frame 62 is disposed with a gap on the front side of the apparatus, with respect to the main frame 60. The guide frame 62 also extends in the apparatus width direction.

Both the main frame 60 and the guide frame 62 are formed of metallic material. In this embodiment, both the main frame 60 and the guide frame 62 are formed of aluminum alloy as an example of a metallic material. Furthermore, the platen 48 is provided in the portion between the main frame 60 and the guide frame 62, as illustrated in FIG. 19.

The guide frame 61 is provided in the main frame 60 to extend in the apparatus width direction, as illustrated in FIG. 19. In addition, a guide frame 168 is provided in the guide frame 62 to extend in the apparatus width direction, as illustrated in FIG. 23. The guide frames 61 and 168 support the carriage 44. The upper surfaces of the guide frames 61 and 168 function as a sliding surface.

In the main frame 60, the carriage driving motor 154 (see FIG. 18) is provided in the end portion on a side (which is the +X-axis directional side in FIG. 17) opposite to the home position side (which is the −X-axis directional side in FIG. 17) of the carriage 44 described below. A driving pulley (not illustrated) is mounted on the carriage driving motor 154.

A driven pulley (not illustrated) is provided in an end portion of the main frame 60, which is the end portion on the home position side (that is, the −X-axis directional side in FIG. 17) of the carriage 44. The driven pulley (not illustrated) can be rotationally driven in accordance with rotation of the driving pulley (not illustrated). A timing belt 170 is wound around both the driving pulley and the driven pulley. In the rear side of the carriage 44, the carriage 44 grips a part of the timing belt 170.

When the carriage driving motor 154 is driven in accordance with the control of the control substrates 152 and 153, the driving pulley (not illustrated) is rotationally driven and the driving pulley drives the timing belt 170. Accordingly, the carriage 44 slides on the guide frames 61 and 168 in the apparatus width direction, that is, the X-axis direction in FIGS. 16 and 17, in a state where the carriage 44 is supported by both the guide frame 61 of the main frame 60 and the guide frame 168 of the guide frame 62.

The carriage 44 can move in the apparatus width direction, within the range of the movement area L3 of the carriage 44 illustrated in FIG. 17. The home position of the carriage 44 is set in the end portion (which is the end portion on the right side of the paper of FIG. 17) on the −X-axis directional side in the movement area L3.

Next, in the movement area L3 (see FIGS. 16 and 17) of the carriage 44, a guiding member 172 is provided outside a transporting path area L4 (see FIGS. 16 and 17) of the paper sheet P, as illustrated in FIGS. 16 to 18. In other words, the guiding member 172 is provided in the end portion in the movement area L3, which is the end portion on the side opposite to the home position side. The guiding member 172 extends in an apparatus depth direction. The guiding member 172 is mounted on the guide frame 62, in a state where the guiding member 172 is bent downward (toward the −Z-axis directional side) in the apparatus height direction, in the front side (the −Y-axis directional side) of the apparatus main body 12.

A part of the guiding member 172 is bent, as illustrated in FIG. 20. The guiding member 172 is mounted on the main frame 60, in a state where the bent portion of the guiding member 172 is in contact with the main frame 60. Furthermore, the guiding member 172 extends through the side (the +Z-axis directional side) above the carriage driving motor 154, mounted on the main frame 60, in the apparatus height direction and the guiding member 172 extends to the rear side (the +Y-axis directional side) of the apparatus main body 12. In this embodiment, the guiding member 172 is formed of metallic material, to reduce, for example, influence of static electricity. Furthermore, in this embodiment, the guiding member 172 is formed of aluminum alloy to reduce weight.

Since the guiding member 172 connects the main frame 60 and the guide frame 62, the main frame 60 and the guide frame 62 support each other through the guiding member 172. Thus, the rigidity thereof is increased. As a result, the guiding member 172 can reinforce both the main frame 60 and the guide frame 62.

The upper surface of the guiding member 172 constitutes a guiding surface 172*a*. The cable 72 described below is disposed on and guided by the guiding surface 172*a*. A bent portion 176 extending in the apparatus depth direction is provided in a part of the guiding member 172, that is, the end portion of the guiding member 172 on the home position side. The bent portion 176 protrudes upward from the guiding surface 172*a* and functions as a guide for the cable 72. The guiding member 172 is a plate-shaped member, and thus the bent portion 176 in the end portion on the home position side also functions as a reinforcing portion for reinforcing the guiding member 172.

The guiding member 172 extends, toward the rear side of the apparatus, to a position located outside the movement area L3 of the carriage 44, in the apparatus depth direction, as illustrated in FIG. 18. A part of the guiding member 172, which is a portion located outside the movement area L3 of the carriage 44 in the apparatus depth direction, is positioned above (in other words, on the +Z-axis directional side) the carriage driving motor 154 for driving the carriage 44. In other words, the guiding member 172 is located in the portion between the cable 72 described below and the carriage driving motor 154. Accordingly, the guiding member 172 blocks electromagnetic waves leaking from the carriage driving motor 154, and thus influence of noise on electric signals transmitted through the cable 72 can be prevented.

A part of the guiding member 172, which is the portion located outside the movement area L3 of the carriage 44, in the apparatus depth direction, is positioned, in the apparatus height direction, below a part, that is, the guiding surface 172*a*, of the guiding member 172, which is the portion located above the movement area L3 of the carriage 44, as illustrated in FIGS. 18 and 24B. In other words, a part of the guiding member 172, which is the portion located outside the movement area L3 of the carriage 44, forms a stepped portion 172*b* which is positioned, in the apparatus height direction, below the guiding surface 172*a* located above the movement area L3 of the carriage 44.

A metallic member 178 is mounted, using a fastening member 180, on the stepped portion 172*b* of the guiding member 172, as illustrated in FIG. 18. in this embodiment, the fastening member 180 is a screw. The metallic member 178 is mounted on the guiding member 172 so as to shield the cable 72 on the guiding member 172 (see FIG. 24B).

In other words, the metallic member 178 is mounted on the stepped portion 172*b* which is positioned, in the apparatus height direction, below the guiding surface 172*a* located above the movement area of the carriage 44. Accordingly, the position of the metallic member 178 in the apparatus height direction can be lowered, compared to in the case where the metallic member 178 is mounted on the guiding surface 172*a* of the guiding member 172. As a result, it is possible to prevent an increase in the size of the printer 10*a* in the apparatus height direction.

The entirety of the metallic member 178 has a plate shape and is formed of metallic material. In this embodiment, the metallic member 178 is formed of aluminum alloy as an example of a metallic material. The metallic member 178 extends in the apparatus depth direction. Both end portions of the metallic member 178 in the apparatus depth direction are bent upward in the apparatus height direction. In other words, both end portions of the metallic member 178 in the apparatus depth direction are directed upward, and thus it is possible to prevent both end portions from damaging the cable 72.

Also, in the central portion of the metallic member 178 in the apparatus depth direction, the home position side in the apparatus width direction is bent upward in the apparatus height direction. This bent portion can prevent the metallic member 178 from damaging the cable 175 described below which extends from the operation portion 18 and passes below the metallic member 178.

In the home position side of the metallic member 178 in the apparatus width direction, hooks 179 are formed on both sides of the central portion, as illustrated in FIG. 24B. When the metallic member 178 is mounted on the guiding member 172, the hooks 179 engage with the guiding member 172. Furthermore, a part of the metallic member 178, which is a portion located on the side opposite to the home position side in the apparatus width direction, is bent downward in the apparatus height direction. The portion bent downward is mounted, using the fastening member 180, on the guiding member 172.

In this embodiment, both the guiding member 172 and the metallic member 178 are formed of metallic material. The guiding member 172 is in contact with the metallic member 178, in such a manner that the metallic member 178 is mounted, using the fastening member 180, on the guiding member 172 or the metallic member 178 engages, using the hooks 179, with the guiding member 172. As a result, conduction between the guiding member 172 and the metallic member 178 can be achieved.

Next, a side frame 182 as a "second frame" will be described with reference to FIGS. 18 to 21. In the apparatus main body 12, the side frame 182 is disposed in the end portion (which is located on the +X-axis directional side in FIGS. 18 and 19) which is located on the side opposite to the home position side in the apparatus width direction. The side frame 182 extends, in the apparatus depth direction, from the front side to the rear side of the apparatus. The side frame 182 is mounted, using a fastening member 184, on the main frame 60 (see FIG. 20). In this embodiment, the fastening member 184 is a screw.

A roller driving mechanism 186 constituted of a plurality of gears is provided in the side frame 182. In the end portion (which is the end portion on the +X-axis directional side in FIG. 18) on the side opposite to the home position side in the apparatus width direction, the roller driving mechanism 186 is positioned on the bottom side (which is the −Z-axis directional side in FIG. 18) of the apparatus.

In the rear side (the +Y-axis directional side in FIG. 21) of the apparatus main body 12, the roller driving motor 142 is provided in the end portion (which is the end portion on the +X-axis directional side) on the side opposite to the home position side in the apparatus width direction, as illustrated in FIG. 21.

The roller driving mechanism 186 drives the transport driving roller 38, in such a manner that the roller driving mechanism 186 causes a driving force from the roller driving motor 142 on the rear side (which is the +Y-axis directional side in FIG. 21) of the apparatus main body 12 to be transmitted from a gear 188*a* mounted on a driving shaft of the roller driving motor 142 to the gear 188*b* which drives the transport driving roller 38 through a plurality of gears. Furthermore, the roller driving mechanism 186 drives the discharge driving roller 56, in such a manner that the roller driving mechanism 186 causes the driving force from the roller driving motor 142 to be transmitted, through a plurality of gears, from the gear 188*b* to a gear 188*c* on the front side (which is the −Y-axis directional side in FIG. 17) of the apparatus main body 12.

In other words, the roller driving mechanism 186 functions as a power transmission mechanism for transmitting power from the roller driving motor 142 to both the transport driving roller 38 and the discharge driving roller 56 as means for transporting the paper sheet P.

A connecting member 190 is provided in the side frame 182, on the rear side of the apparatus in the apparatus depth direction. The connecting member 190 is formed of metallic material. The connecting member 190 electrically connects the side frame 182 and the control substrate 153. Specifically, one end portion of the connecting member 190 is mounted, using a fastening member 192, on the side frame 182 and the other end portion is mounted, using a fastening member 194, on the control substrate 153. In this embodiment, the fastening members 192 and 194 are screws.

Here, both the control substrate 152 and the control substrate 153 will be described. Both the control substrate 152 and the control substrate 153 include a plurality of electronic components and function as a controller of the printer 10*a*. The control substrate 152 is disposed in the bottom surface of the apparatus main body 12, as illustrated in FIG. 27. Meanwhile, the control substrate 153 is provided in the end portion on the rear side of the apparatus main body 12, as illustrated in FIGS. 21, 23, and 25. The control substrate 152 is electrically connected to the control substrate 153. Although not illustrated, a ground is provided in at least either the control substrate 152 or the control substrate 153. Both the control substrate 152 and the control substrate 153 can be earthed through the ground.

In this case, the metallic member 178 is in contact with the guiding member 172, the guiding member 172 is in contact with the main frame 60, and the main frame 60 is in contact with the side frame 182, as illustrated in FIGS. 18, 20, and 21. Furthermore, the side frame 182 is in contact with the control substrate 153, through the connecting member 190. Accordingly, the metallic member 178 is electrically connected to the control substrate 153, through the guiding member 172, the main frame 60, the side frame 182, and the connecting member 190. As a result, the metallic member 178 is earthed through a ground (not illustrated) in the control substrate 152 or the control substrate 153.

In other words, the metallic member 178 is electrically connected to the grounds in the control substrates 152 and 153, through the guiding member 172, the main frame 60, and the side frame 182. Accordingly, the metallic member 178 is electrically earthed, and thus it is possible to stably reduce influence of noise on the cable 72. Furthermore, since a path for earthing the metallic member 178 is constituted by the main frame 60 constituting the apparatus main body 12, it is not necessary to separately provide a path for earthing the metallic member 178. As a result, the configuration of the printer 10*a* can be simplified and it is possible to prevent an increase in the size of the printer 10*a*.

Routing of Cable

Routing of Cable from Carriage to Control Substrate

Next, routing of both the cable 72 and the cable 175 in the apparatus main body 12 will be described with reference to FIGS. 22 to 27. The cable 72 is constituted of a flexible flat cable (FFC) performing transceiving of control signals or data between the carriage 44 and the control substrate 152. In other words, one end of the cable 72 is connected to the carriage 44 and the other end is connected to the control substrate 152.

The other end of the cable 175 of this embodiment is divided into three end portions and the three end portions are connected to the control substrate 152. A first end portion of the three end portions of the cable 175 performs, between the carriage 44 and the control substrate 152, transceiving of control signals relating to a rear encoder (not illustrated). A second end portion performs, between the carriage 44 and the control substrate 152, transceiving of recognition signals relating to the ink cartridge 51 which is detachably mounted on the carriage 44. A third end portion performs, between the carriage 44 and the control substrate 152, transceiving of control signals relating to the recording head 46.

The cable 175 is constituted of a flexible flat cable (FFC) performing transceiving of control signals or data between the operation portion 18 and the control substrate 152. In other words, one end of the cable 175 is connected to the operation portion 18 and the other ends are connected to the control substrate 152.

First, routing of the cable 72 in a state where the carriage 44 is located in the end portion (which is the end portion on the −X-axis directional side in FIG. 22) on the home position side in the movement area L3 will be described. The one end of the cable 72 is connected to the rear side (which is the +Y-axis directional side in FIG. 22) of the carriage 44, as illustrated in FIG. 22. The cable 72 extending from the rear side extends from the rear side (which is the +Y-axis directional side) to the front side (which is the −Y-axis directional side), along the end portion (which is the end portion on the −X-axis directional side in FIG. 22) on the home position side of the carriage 44.

The cable 72 routed to the front side (which is the −Y-axis directional side) of the carriage 44 extends, in the apparatus width direction along the rear surface of the guide frame 62, from the home position side (which is the −X-axis directional side in FIG. 23) to the end portion (which is the end portion on the +X-axis directional side in FIG. 23) on the side opposite to the home position side, as illustrated in FIG. 23.

In this case, a plurality of cable fixing hooks 62*b* are provided in the rear surface of the guide frame 62, as illustrated in FIG. 23. In this embodiment, the cable fixing hooks 62*b* are provided in the rear surface of the guide frame 62, at two positions which are the central portion in the apparatus width direction and the end portion (which is the end portion on the +X-axis directional side in FIG. 23) on the side opposite to the home position side. The cable fixing hooks 62*b* hold the cable 72, on the rear surface of the guide frame 62.

Next, when the carriage 44 moves in the apparatus width direction, for example, the carriage 44 moves from the end portion (which is the end portion on the −X-axis directional side in FIG. 17) on the home position side relating to the carriage 44 to the end portion (which is the end portion on the +X-axis directional side in FIG. 17) on the opposite side, the cable 72 follows the movement of the carriage 44 in such a manner that the cable 72 is bent, in accordance with the movement of the carriage 44 in the apparatus width direction, within the movement area L3 of the carriage 44, at the cable fixing hook 62*b*, functioning as a fulcrum, which is located in the central portion of the rear surface of the guide frame 62 in the apparatus width direction, as illustrated in FIG. 17.

In other words, a part of the cable 72 held in the rear surface of the guide frame 62, which is the portion extending from the cable fixing hook 62*b* in the central portion of the rear surface in the apparatus width direction to the end portion on the home position side can be separated from the rear surface to the rear side of the apparatus in the apparatus depth direction, as illustrated in FIG. 17. Accordingly, the cable 72 can be bent in the movement area L3 of the carriage 44, in accordance with the movement of the carriage 44. As a result, the cable 72 can follow the movement of the carriage 44.

Next, the cable 72 is bent from the rear side to the front side of the guide frame 62, in the end portion (which is the end portion on the +X-axis directional side in FIGS. 23 and 24A) of the guide frame 62, which is the end portion on the side opposite to the home position side, as illustrated in FIGS. 23 and 24A. The, the cable 72 bent to the front side of the guide frame 62 is bent upward in the apparatus height direction and extends, along the guiding member 172, to the guiding surface 172*a*.

The direction of the cable 72 is changed, on the guiding surface 172*a* of the guiding member 172, to be directed to the rear side of the apparatus in the apparatus depth direction. Then, the cable 72 is routed to the rear side of the apparatus, along the guiding surface 172*a*. The cable 72 is adhered, using, for example, an adhesive agent (not illustrated), to the guiding surface 172*a* of the guiding member 172. The bent portion 176 guides the cable 72 on the guiding surface 172*a*, along the apparatus depth direction.

Next, in a position outside the movement area L3 of the carriage 44, in the apparatus depth direction, the cable 72 extending along the guiding surface 172*a* of the guiding member 172 passes below the metallic member 178 mounted on the guiding member 172. In other words, the cable 72 is pinched, in the apparatus height direction, between the guiding member 172 and the metallic member 178. Accordingly, the upper side of the cable 72 is shielded by the metallic member 178 and the lower side of the cable 72 is shielded by the guiding member 172.

Since the metallic member 178 is mounted on the guiding member 172, in a state where the cable 72 is pinched between the metallic member 178 and the guiding member 172, it is possible to prevent swinging or vibration of the cable 72. As a result, it is possible to prevent influence of noise due to swinging or vibration of the cable 72. Furthermore, since the metallic member 178 is electrically connected to the grounds in the control substrates 152 and 153, it is possible to prevent influence of noise from outside.

Next, in the printer 10*a*, the cable 72 is routed to the rear side (which is the +Y-axis directional side in FIG. 24A), in the end portion (which is the end portion on the +X-axis directional side in FIG. 25) on the side opposite to the home position side in the apparatus width direction, as illustrated in FIGS. 25 and 26. Then, the direction of the cable 72 is changed and the cable 72 extends to the home position side (which is the −X-axis directional side in FIG. 25) in the apparatus width direction. Subsequently, the direction of the cable 72 is changed in the central portion of the printer 10*a* in the apparatus width direction such that the cable 72 is directed to the lower side, that is, the −Z-axis directional side, of the printer 10*a* in the apparatus height direction. Next, the other ends of the cable 72 are connected to the control substrate 152 in the lower surface of the printer 10*a*, as illustrated in FIG. 26.

The operation portion 18 is disposed, in the apparatus depth direction, on an apparatus rear side (which is the +Y-axis directional side in FIGS. 23 and 24A) of the main frame 60, as illustrated in FIGS. 23, 24A, 25, and 26. The cable 175 in a state where one end of the cable 175 is connected to an end portion (which is the end portion on the +X-axis directional side in FIG. 23) of the operation portion 18, which is the end portion on the side opposite to the home position side in the apparatus width direction, extends from the operation portion 18 to the side opposite to the home position side. Then, the cable 175 is directed to the upper surface of the guiding member 172. Subsequently, the cable 175 is drawn, in the apparatus height direction, to the portion between the guiding member 172 and the metallic member 178.

The description of routing of the cable 175 from the guiding member 172 to the control substrate 152 is similar to that of the cable 72 and will not be repeated. The other end of the cable 175 is connected to the control substrate 152.

In other words, in this embodiment, the cable 72 connected to the control substrate 152 passes across the upper side of at least a part of the movement area L3 of the carriage 44. Thus, it is not necessary to provide, outside the movement area L3 of the carriage 44, in the apparatus width direction as a predetermined movement direction, a space for allowing the cable 72 to pass therethrough. As a result, it is possible to reduce the size of the apparatus in the predetermined movement direction, that is, the width direction of the recording apparatus. Furthermore, the metallic member 178 is provided above the cable 72, in a state where the metallic member 178 partially shields at least a part of the cable 72, which is the portion extending in the apparatus depth direction intersecting the predetermined movement direction. Accordingly, the metallic member 178 blocks noise acting on the cable 72 from outside. As a result, it is possible to stably reduce noise acting on the cable 72, and thus it is possible to prevent an incorrect operation of the apparatus. Furthermore, since the noise removal is performed by the metallic member 178, it is possible to reduce costs, compared to in a case of using a resin material.

Since the metallic member 178 of this embodiment shields not only the cable 72 but also the cable 175, it is not necessary to shield the cable 72 and the cable 175, using separate members. Accordingly, since both the cable 72 and the cable 175 are shielded by one member, it is possible to achieve space saving and a reduction in costs.

Layout of Guiding Member and Metallic Member in Apparatus Main Body

Next, the positional relationship between the operation portion 18, the guiding member 172, and the metallic member 178 will be described with reference to FIG. 27. When, in the apparatus main body 12, the cover portion 16 is open (see FIG. 2) with respect to the apparatus main body 12, the operation portion 18 is exposed at the upper surface of the apparatus main body 12. Accordingly, the operation portion 18 is positioned, in the apparatus height direction, on the upper side of the apparatus main body 12. In this embodiment, the guiding member 172, the metallic member 178, and the cables 72 and 175 pinched between the guiding member 172 and the metallic member 178 overlap, in the apparatus height direction, with at least a part of the installation area of the operation portion 18.

In other words, since the metallic member 178 overlaps, in the apparatus height direction, with at least a part of the installation area of the operation portion 18, it is possible to reduce the size of the apparatus in the apparatus height direction, compared to in the case where the cables 72 and 175 shielded by the metallic member 178, the metallic member 178, and the operation portion 18 are arranged, in a stacked manner, in the apparatus height direction. As a result, it is possible to achieve a reduction in the size of the printer 10*a*.

Modification Examples of Embodiment (1) In this embodiment, the side frame 182 and the control substrate 153 are in contact with each other, via the connecting member 190. In other words, both members are indirectly in contact with each other. However, without using the configuration described above, the side frame 182 and the control substrate 153 may be directly in contact with each other.

(2) In this embodiment, the metallic member 178 is mounted on the stepped portion 172*b* of the guiding member 172. However, the metallic member 178 may be mounted on the guiding surface 172*a* and shield the cable 72. Alternatively, the metallic member 178 may be mounted on the rear surface of the guide frame 62 and shield the cable 72 routed on the rear surface.

(3) In this embodiment, the guiding member 172 and the metallic member 178 are separate bodies and the metallic member 178 is mounted on the guiding member 172. However, without using the configuration described above, the guiding member 172 may be subjected to bending processing and shield the cables 72 and 175.

A summary of the above description follows. The printer 10*a* of this embodiment includes the control substrates 152 and 153, the carriage 44, the cable 72, and the metallic member 178. The control substrates 152 and 153 control the recording operation relating to the paper sheet P. The carriage 44 can move in the apparatus width direction as a predetermined movement direction, in accordance with the control of the control substrates 152 and 153. The cable 72 is connected to both the control substrates 152 and 153 and the carriage 44 and passes across the upper side of at least a part of the movement area of the carriage 44, in the apparatus width direction. The metallic member 178 partially shields at least a part of the cable 72, which is the portion extending in the apparatus depth direction intersecting the predetermined movement direction of the cable 72.

The printer 10*a* includes the guiding member 172 which is formed of metal and guides the cable 72 and the control substrates 152 and 153 constituting the controller. Furthermore, the metallic member 178 is mounted on the guiding member 172, in a state where the cable 72 is pinched between the metallic member 178 and the guiding member 172. The metallic member 178 is electrically connected to the grounds in the control substrates 152 and 153.

In addition, the printer 10*a* includes the housing 14 and the paper supply portion 28 for feeding a paper sheet. The metallic member 178 is provided, in the apparatus height direction intersecting the predetermined movement direction, in a space between the housing 14 and the guiding member 172. Furthermore, the metallic member 178 is provided, close to the paper supply portion 28, at a position corresponding to a part of the cable 72, which is the portion outside the movement area of the carriage 44, in the apparatus depth direction intersecting the predetermined movement direction. Accordingly, it is possible to reduce the size in the apparatus height direction, compared to in the case where the metallic member 178 is disposed above the movement area of the carriage 44. In other words, it is possible to prevent an increase in the size of the printer 10*a* in the apparatus height direction.

In the printer 10*a*, the metallic member 178 is provided, in the apparatus width direction as a predetermined movement direction, in the portion between the paper supply portion 28 and the housing 14.

In the printer 10*a*, a part of the guiding member 172, which is the portion located outside the movement area L3 of the carriage 44, in the apparatus depth direction intersecting the predetermined movement direction, forms the stepped portion 172*b* which is positioned, in the apparatus height direction, below the guiding surface 172*a* located above the movement area of the carriage 44. The metallic member 178 is mounted on the stepped portion 172*b*.

The printer 10*a* includes the carriage driving motor 154 which drives the carriage 44 in the apparatus width direction as a predetermined movement direction. The stepped portion 172*b* of the guiding member 172 is positioned, in the apparatus height direction, above the carriage driving motor 154.

Metal frames 162 and 182 constituting the apparatus main body 12 are provided in the printer 10*a*. The guiding member 172 is connected to the metal frames 162 and 182.

In the printer 10*a*, the metal frames 162 and 182 include the main frame 162 and the side frame 182 which are assembled and form the apparatus main body 12. The guiding member 172 is in contact with the main frame 162 and the side frame 182 is directly/indirectly in contact with the control substrate 153. The metallic member 178 is electrically connected to the ground in the control substrate 153, through the guiding member 172, the main frame 60, and the side frame 182.

In the printer 10*a*, the guiding member 172 is provided, in the apparatus width direction as a predetermined movement direction, in the end portion in the movement area L3 of the carriage 44. Furthermore, the printer 10*a* includes the operation portion 18 which sends commands to the control substrates 152 and 153 as a controller. The metallic member 178 overlaps, in the apparatus height direction, with at least a part of the installation area of the operation portion 18.

The printer 10*a* includes the cable 175 which extends from the operation portion 18 and is connected to the control substrate 152 as a controller. The metallic member 178 also shields the cable 175.

The printer 10*a* includes the control substrates 152 and 153 which control the recording operation relating to a recording medium, the operation portion 18 which sends commands to the control substrates 152 and 153, the cable 72 which is connected to the control substrate 152, and the metallic member 178 which shields at least a part of the cable 72. The metallic member 178 overlaps, in the apparatus height direction, with at least a part of the installation area of the operation portion 18.

In Embodiments 1 and 2, the guiding members 70 and 172 of the invention are applied to an ink jet printer as an example of a recording apparatus. However, the guiding members 70 and 172 can be applied to general liquid ejecting apparatuses other than an ink jet printer. In Embodiment 2, the metallic member 178 of the invention is applied to an ink jet printer as an example of a recording apparatus. However, the metallic member 178 can be applied to general liquid ejecting apparatuses other than an ink jet printer.

Here, the liquid ejecting apparatus is not limited to a recording apparatus, such as a printer, a copying machine, and a facsimile machine, which has an ink jet type recording head and performs recording on a recording medium, in such a manner that the recording head discharges ink onto the recording medium. The liquid ejecting apparatus includes an apparatus in which a liquid ejecting head corresponding to the ink jet type recording head ejects, instead of ink, a liquid which replaces ink, onto an ejection target medium corresponding to a recording medium and the liquid is applied to the ejection target medium.

The liquid ejecting head includes not only the recording head described above but also a coloring material ejecting head used to manufacture a color filter for a liquid crystal display or the like, an electrode material (conductive pastes) ejecting head used to form an electrode for an organic EL display, a field emission display (FED), or the like, a bio-organic material ejecting head used to manufacture a biochip, a sample ejecting head as a precision pipette, or the like.

The invention is not intended to be limited to the embodiments described above. It is possible to make various modifications as long as they do not depart from the scope of claims and, needless to say, they are within the scope of the invention.

The entire disclosure of Japanese Patent Application No. 2013-270007 filed on Dec. 26, 2013 and No. 2014-118424 filed on Jun. 9, 2014 are expressly incorporated by reference herein.

What is claimed is:

1. A recording apparatus comprising:

a controller which controls a recording operation relating to a recording medium;

a first cable which is connected to the controller; and a carriage which can move in a predetermined movement direction, in accordance with control of the controller, a first guide frame and a second guide frame for guiding the movement of the carriage, a guide member which guides the first cable, the guide member attached to the second guide frame and extended towards the first guide frame, wherein, a carriage path extends under the guide member at a part of a carriage movement area, and wherein, the guide member is positioned outside a recording medium transporting path, in the predetermined movement direction.

2. The recording apparatus according to claim 1, wherein the guiding member is provided in an end portion of the carriage movement area, in the predetermined movement direction.

3. The recording apparatus according to claim 2, wherein the carriage includes a recording head which discharges ink onto a recording medium, and wherein the first cable guided by the guiding member is electrically connected to the recording head of the carriage.

4. The recording apparatus according to claim 1, further comprising:

a metallic member which partially shields at least a part of the first cable, which is a portion extending in a direction intersecting the predetermined movement direction.

5. The recording apparatus according to claim 4, further comprising:

a substrate constituting the controller, wherein the guiding member is formed of metal, wherein the metallic member is mounted on the guiding member, in a state where the first cable is pinched between the metallic member and the guiding member, and wherein the metallic member is electrically connected to a ground in the substrate.

6. The recording apparatus according to claim 5, further comprising:

a case body; and a feeding portion which feeds a medium, wherein, in an apparatus height direction intersecting the predetermined movement direction, the metallic member is provided in a space between the case body and the guiding member, and wherein the metallic member is disposed, close to the feeding portion, at a position corresponding to a part of the first cable, which is the portion outside the carriage movement area, in a direction intersecting the predetermined movement direction.

7. The recording apparatus according to claim 6, wherein the substrate is provided on either the rear side of the feeding portion in the case body or the bottom surface of the case body.

8. The recording apparatus according to claim 7, further comprising:

an operation portion which sends a command to the controller, wherein, in the apparatus height direction, the guiding member overlaps at least a part of the installation area of the operation portion.

9. The recording apparatus according to claim 8, further comprising:

an apparatus main body which is provided with the operation portion; and a cover which is pivotally mounted on the apparatus main body and can switch a state between an open state where the operation portion is exposed to the area above the apparatus main body and a closed state where the operation portion is covered by the cover, wherein, in the apparatus height direction, the guiding member overlaps at least a part of the cover.

10. The recording apparatus according to claim 9, further comprising:

a power transmission mechanism which transmits power from a driving source to means for transporting the recording medium, wherein, when the carriage is moved to the end portion in the carriage movement area, the power transmission mechanism is positioned below the carriage and the guiding member is positioned above the carriage, the power transmission mechanism, the carriage, and the guiding member thus overlapping each other.

11. The recording apparatus according to claim 10, wherein the guiding member is positioned above a driving motor for driving the carriage.

12. The recording apparatus according to claim 11, wherein, in the predetermined movement direction, the metallic member is provided in a portion between the feeding portion and the case body.

13. The recording apparatus according to claim 12, wherein a part of the guiding member, which is the portion outside the carriage movement area, in the direction intersecting the predetermined movement direction, forms a stepped portion which is positioned, in the apparatus height direction, below a part of the guiding member, which is the portion provided above the carriage movement area, and wherein the metallic member is mounted on the stepped portion.

14. The recording apparatus according to claim 13, further comprising:

a metal frame which forms the apparatus main body, wherein the guiding member is connected to the metal frame.

15. The recording apparatus according to claim 14, wherein the metal frame includes a first frame and a second frame which are assembled together and form the apparatus main body, wherein the guiding member is in contact with the first frame, wherein the second frame is directly/indirectly connected to the substrate, and wherein the metallic member is electrically connected to the ground in the substrate, through the guiding member, the first frame, and the second frame.

16. The recording apparatus according to claim 15, further comprising:

a second cable which extends from the operation portion and is connected to the controller, wherein the metallic member shields the second cable.

* * * * *